US008126371B2

(12) United States Patent
Akedo

(10) Patent No.: US 8,126,371 B2
(45) Date of Patent: Feb. 28, 2012

(54) DEVELOPING DEVICE AND IMAGE FORMING APPARATUS AND TONER SUPPLYING METHOD USING THE SAME

(75) Inventor: Shuichi Akedo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 295 days.

(21) Appl. No.: 12/501,862

(22) Filed: Jul. 13, 2009

(65) Prior Publication Data

US 2010/0028052 A1 Feb. 4, 2010

(30) Foreign Application Priority Data

Jul. 31, 2008 (JP) ..... 2008-197740
Jan. 8, 2009 (JP) ..... 2009-002186

(51) Int. Cl.
*G03G 15/08* (2006.01)

(52) U.S. Cl. ..... 399/254; 399/119; 399/255; 399/258
(58) Field of Classification Search ..... 399/119, 399/254, 255, 258
See application file for complete search history.

(56) References Cited

U.S. PATENT DOCUMENTS 6,415,125 B1 7/2002 Yamamoto et al.
2004/0037575 A1* 2/2004 Ishida ..... 399/258

FOREIGN PATENT DOCUMENTS

| | | | |
|---|---|---|---|
| JP | 10-63081 | A | 3/1998 |
| JP | 2001-166575 | A | 6/2001 |
| JP | 2005-134767 | A | 5/2005 |
| JP | 2008-145875 | A | 6/2006 |
| JP | 2008-90183 | A | 4/2008 |

* cited by examiner

*Primary Examiner* — Ryan Walsh
(74) *Attorney, Agent, or Firm* — Birch, Stewart, Kolasch & Birch, LLP

(57) ABSTRACT

A developing device includes: a developing vessel for storing a developer D containing a toner and a magnetic carrier; a first conveying passage for conveying the developer; a first conveying member provided in the first conveying passage for agitating and conveying the developer in a predetermined direction; a developing roller; a toner supply port for supplying toner to the first conveying passage; and an electromagnet arranged at the outer periphery of the toner supply port, and is constructed such that the toner supply port is formed over the first conveying member and the electromagnet intermittently attracts the developer residing under the toner supply port.

9 Claims, 20 Drawing Sheets

DEVELOPING DEVICE AND IMAGE FORMING APPARATUS AND TONER SUPPLYING METHOD USING THE SAME

This Nonprovisional application claims priority under 35 U.S.C. §119(a) on Patent Application No. 2008-197740 filed in Japan on 31 Jul. 2008 and Patent Application No. 2009-002186 filed in Japan on 8 Jan. 2009, the entire contents of which are hereby incorporated by reference.

BACKGROUND OF THE INVENTION (1) Field of the Invention

The present invention relates to a developing device as well as to an image forming apparatus and toner supplying method using the device, in particular relating to a developing device using a dual-component developer containing a toner and a magnetic carrier, for use in an image forming apparatus for forming image using the toner based on electrophotography, such as an electrostatic copier, laser printer, facsimile machine or the like, as well as to an image forming apparatus and toner supplying method using this device.

(2) Description of the Prior Art

Conventionally, image forming apparatuses based on electrophotography such as copiers, printers, facsimile machines and the like have been known. The image forming apparatus using electrophotography is constructed so as to form an image by forming an electrostatic latent image on the photoreceptor drum (toner image bearer) surface, supplying toner to the photoreceptor drum from a developing device to develop the electrostatic latent image, transferring the toner image formed on photoreceptor drum by development to a sheet of paper or the like, and fusing the toner image onto the sheet by means of a fusing device.

Recently, in the image forming apparatuses capable of reproducing full-color and high-quality images, a dual-component developer (which will be referred to hereinbelow as simply "developer"), which can present excellent charge performance stability, is often used.

This developer consists of a toner and a carrier, which are agitated in the developing device and frictionally rubbed with each other to produce appropriately electrified toner.

In the developing device, the electrified toner is supplied to a developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Besides, recently there is a demand for high-speed performance and miniaturization on image forming apparatuses, it is hence necessary to electrify the developer quickly and sufficiently and also convey the developer rapidly.

To deal with such circumstances, in order to promptly diffuse supplied toner into the developer and produce an appropriate amount of static charge on the toner, a circulating type developing device has been adopted in some image forming apparatuses. This circulating type developing device includes a developer conveying passage through which the developer is circulatively conveyed and a developer conveying member which agitates and conveys the developer through the developer conveying passage (see patent document 1: Japanese Patent Application Laid-open Hei 10 No. 63081).

The above-mentioned circulating type developing device is constructed such that toner is supplied from a toner hopper to the developer conveying passage when the toner concentration in the developer inside the developing device becomes lower than a predetermined level.

However, since the specific weight of the toner in the developer is rather low compared to that of the carrier (about one third), the supplied toner is likely to float over the developer. As a result, the conventional circulating type developing device has the problem that if a large amount of toner is supplied from the toner hopper to the developer conveying passage, the toner is conveyed as it remains in lumps over the developer.

As a result, there occurred such situations that the toner that has not been sufficiently mixed with the carrier (the toner that has a lower amount of static charge without being sufficiently electrified) is supplied to the developing roller.

That is, if the toner that has not been sufficiently electrified is supplied to the developing roller, the toner becomes prone to scatter from the developing roller, hence giving rise to the problem that the scattered toner soils the interior of the image forming apparatus and the images formed on the paper.

Further, if the toner that has not been sufficiently charged is supplied to the developer supporting member, there occurs the problem that the electrostatic force for retaining toner particles on the carrier surface becomes weak and the toner particles are prone to adhere to non-image areas and produce a foggy image.

In contrast, if the space over the developer in the developer conveying passage is totally eliminated, excess stress acts on the developer, causing the problems that the abrasion of the developer is accelerated so that the life of the developer is shortened, and that the developer becomes unable to be conveyed. The reason of these problems can be considered as follows. That is, the bulk density of the developer is always changing depending of the toner concentration in the developer and the amount of static charge on toner, but if there is no space for absorbing the change, the internal pressure on the developer becomes higher. Particularly, there has been the problem that when the bulk density of the developer becomes higher near the toner supply port, the supplied toner bridges the space around the toner supply port, causing toner blocking.

On the other hand, if an agitating paddle with a high agitating capability is provided, it is possible to improve the performance of agitation and mixture between the supplied toner and the developer, but there is still the problem that excessive stress acts on the developer, hence abrasion of the developer is promoted and the life of the developer is shortened.

SUMMARY OF THE INVENTION

The present invention has been devised in view of the above conventional problems, it is therefore an object of the present invention to provide a developing device in which toner that has not been sufficiently charged is prevented from being supplied to the developing roller so as to be able to reduce toner scattering and image fogging, as well as providing an image forming apparatus and toner supplying method using the device.

In order to solve the above problems, the developing device and the image forming apparatus and toner supplying method using this device, are configured as follows:

The first aspect of the present invention resides in a developing device, comprising: a developer receptacle for storing a developer containing a toner and a magnetic carrier; a developer conveying passage through which the developer is conveyed; a developer conveying member disposed inside the developer conveying passage to agitate and convey the developer in a predetermined direction; a developer supporting member which supports the developer in the developer conveying passage to supply the toner contained in the developer to a photoreceptor drum; a toner supply port for taking a supply of the toner into the developer conveying passage; and, an electromagnet provided at the outer periphery of the toner supply port, and being characterized in that the toner supply port is formed over the developer conveying member, and the electromagnet intermittently attracts the developer residing under the toner supply port.

In the second aspect of the present invention, the developing device having the above first aspect further includes a developer receptacle cover provided on the top of the developer receptacle, and is characterized in that the toner supply port is formed in the developer receptacle cover, the developer receptacle cover includes a developer retreat that is projected upward to form a space capable of holding the developer inside the developer receptacle, the developer retreat is formed at the outer periphery of the toner supply port, and the electromagnet is arranged at such a position as to form a magnetic field in the space of the developer retreat. In particular, it is preferred that the magnetic field created in the space of the developer retreat is formed over the developer so as to be directed horizontally.

In accordance with the third aspect of the present invention, it is preferred that the developer conveying member is comprised of a helical screw auger.

The fourth aspect of the present invention is characterized in that the electromagnet is disposed on the upstream side of the toner supply port with respect to the rotational direction of the developer conveying member.

The fifth aspect of the present invention is characterized in that the electromagnet is disposed on the upstream side of the toner supply port with respect to the developer's direction of conveyance by the developer conveying member.

The sixth aspect of the present invention is characterized in that the electromagnet is constituted of a plurality of electromagnets each of which creates a magnetic field oriented in the same direction with that of others.

The seventh aspect of the present invention is characterized in that the plural electromagnets are energized successively from the one located closer to the developer.

The eighth aspect of the present invention is characterized in that the electromagnet is energized so as to form a magnetic field intermittently on a cycle ranging from 0.5 second to 2 seconds.

In accordance with the ninth aspect of the present invention, an image forming apparatus for forming images with toner based on electrophotography, includes: a photoreceptor drum that an electrostatic latent image is formed on the surface of; a charging device for electrifying the surface of the photoreceptor drum; an exposure device for forming the electrostatic latent image on the photoreceptor drum surface; a developing device for forming a toner image by supplying toner to the electrostatic latent image on the photoreceptor drum surface; a toner supply device for supplying the toner to the developing device; a transfer device for transferring the toner image on the photoreceptor drum surface to a recording medium; and a fusing device for fusing the toner image on the recording medium, and is characterized in that the developing device employs the developing device having any one of the first to eighth aspects.

In accordance with tenth aspect of the present invention, a toner supplying method for supplying toner to a developing device, which comprises: a developer receptacle for storing a developer containing a toner and a magnetic carrier; a developer conveying passage through which the developer is conveyed; a developer conveying member disposed inside the developer conveying passage to agitate and convey the developer in a predetermined direction; and a toner supply port for taking a supply of the toner into the developer conveying passage, includes the step of supplying the toner from the toner supply port into the developer receptacle while generating a magnetic field intermittently in the space under the toner supply port.

For example, the toner is supplied from the toner supply port into the developer receptacle while a magnetic field is intermittently generated under that toner supply port by the electromagnet that is provided at the outer periphery of the toner supply port so as to alternately attract and release the developer by the magnetic field generated by the electromagnet.

In the eleventh aspect of the present invention, the toner supplying method having the above tenth aspect further includes the steps of: supplying toner when a magnetic field is generated under the toner supply port; and suspending toner supply when no magnetic field is generated under the toner supply port.

For example, the toner supplying method includes the step of supplying toner while the developer is being attracted by the magnetic field generated by energizing the electromagnet provided at the outer periphery of the toner supply port and the step of suspending toner supply while the magnetic field is being canceled by suspending the current through the electromagnet.

According to the first aspect of the present invention, when supplying toner, the electromagnet is energized intermittently so as to create a magnetic field in an intermittent manner to repeat attraction (raising) of the developer under the toner supply port and releasing (dropping) of it, whereby it is possible to promote the developer to move up and down and improve the mixture performance of the supplied toner with the developer. As a result, agitation of the developer and supplied toner can be performed desirably so that the charge performance of supplied toner is improved, thus making it possible to reduce toner scattering and image fogging due to an insufficiency of static charge on the toner. Accordingly, it is possible to provide fine images.

According to the second aspect of the present invention, the developer drawn up by the electromagnet can be held inside the space of the developer retreat, it is possible to draw up a large amount of developer from the developer conveying passage. As a result, it is possible to lower the surface level of the developer in the developer conveying passage, so that the supplied toner falls into the lower part of the developer conveying member (the developer conveying passage). As a result, the rotational frictional force of the developer conveying member becomes more influential so as to be able to improve the mixture performance of supplied toner with the developer.

Further, formation of the space of the developer retreat also contributes to prevention against heat generation of the developer inside the developer receptacle.

According to the third aspect of the present invention, since use of the helical screw auger as the developer conveying member makes the developer easily move in the rotational direction of the developer conveying member, the developer located under the toner supply port can be promptly attracted toward the electromagnet when the magnetic field is created by the electromagnet, securing improved response of the developer to the electromagnet.

According to the fourth aspect of the present invention, since the electromagnet is disposed on the upstream side of the toner supply port with respect to the rotational direction of the developer conveying member, the developer is collected on the upstream side with respect to the rotational direction of the developer conveying member when the developer located under the toner supply port is attracted to the electromagnet by the influence of its magnetic field. Accordingly, a space is formed on the downstream side with respect to the rotational direction of the developer conveying member, and the supplied toner can be made to fall into this space. Then, the developer that has been attracted flows over the supplied toner after cancellation of the magnetic field of the electromagnet, hence it is possible to easily mix the toner into the developer even if the toner has a low specific weight.

According to the fifth aspect of the present invention, since the electromagnet is disposed on the upstream side of the toner supply port with respect to the developer's direction of conveyance by the developer conveying member, the developer is obstructed to flow on the upstream side of the toner supply port with respect to the developer's direction of conveyance when the developer located under the toner supply port is attracted to the electromagnet by the influence of its magnetic field. Accordingly, the developer surface under the toner supply port becomes lower than the surface level of the developer that has been obstructed to flow, so that the supplied toner can be made to fall into this space. Then, the developer that has been obstructed covers the supplied toner after cancellation of the magnetic field of the electromagnet, hence the toner goes down under the developer to thereby promote mixture of the toner having a lower specific weight with the developer having a higher specific weight.

According to the sixth aspect of the present invention, since a plurality of electromagnets which each create a magnetic field oriented in the same direction with that of others are used, the magnetic lines of force from one electromagnet converge to the other electromagnet. Accordingly, it is possible to suppress spreading of magnetic lines of force. As a result, it is possible to prevent the developer, attracted by the magnetic lines of force, from blocking the toner supply port.

According to the seventh aspect of the present invention, since the plural electromagnets are energized sequentially from the one located closer to the developer, the developer can be attracted successively from the part closer to the developer surface, thus making it possible to draw up the developer in a stable manner.

According to the eighth aspect of the present invention, since the electromagnet is energized so as to form a magnetic field intermittently on a cycle ranging from 0.5 second to 2 seconds, when supplying toner attraction (raising) of the developer under the toner supply port and releasing (dropping) of it can be repeated alternately, whereby it is possible to promote the developer to move up and down and improve the mixture performance of the supplied toner with the developer.

According to the ninth aspect of the present invention, the supplied toner is promptly mixed with the developer so that the charge performance of supplied toner is improved. As a result it is possible to solve the problems of toner scattering and image fogging due to an insufficiency of static charge on the toner.

According to the tenth aspect of the present invention, since raising and release of the developer surface are repeated by alternating attraction and release of the developer by intermittent generation of a magnetic field, it is possible to mix the supplied toner into the developer, hence improve the mixture performance of the toner and the developer, which have different specific weights.

According to the eleventh aspect of the present invention, since the developer drawn up by the generated magnetic field flows over the supplied toner when the developer is released by cancellation of the magnetic field, it is possible to easily mix the toner having a lower specific weight into the developer.

DESCRIPTION OF THE PREFERRED EMBODIMENTS

The embodied modes for carrying out the present invention will be described with reference to the drawings.

The First Embodiment

Figure 1:
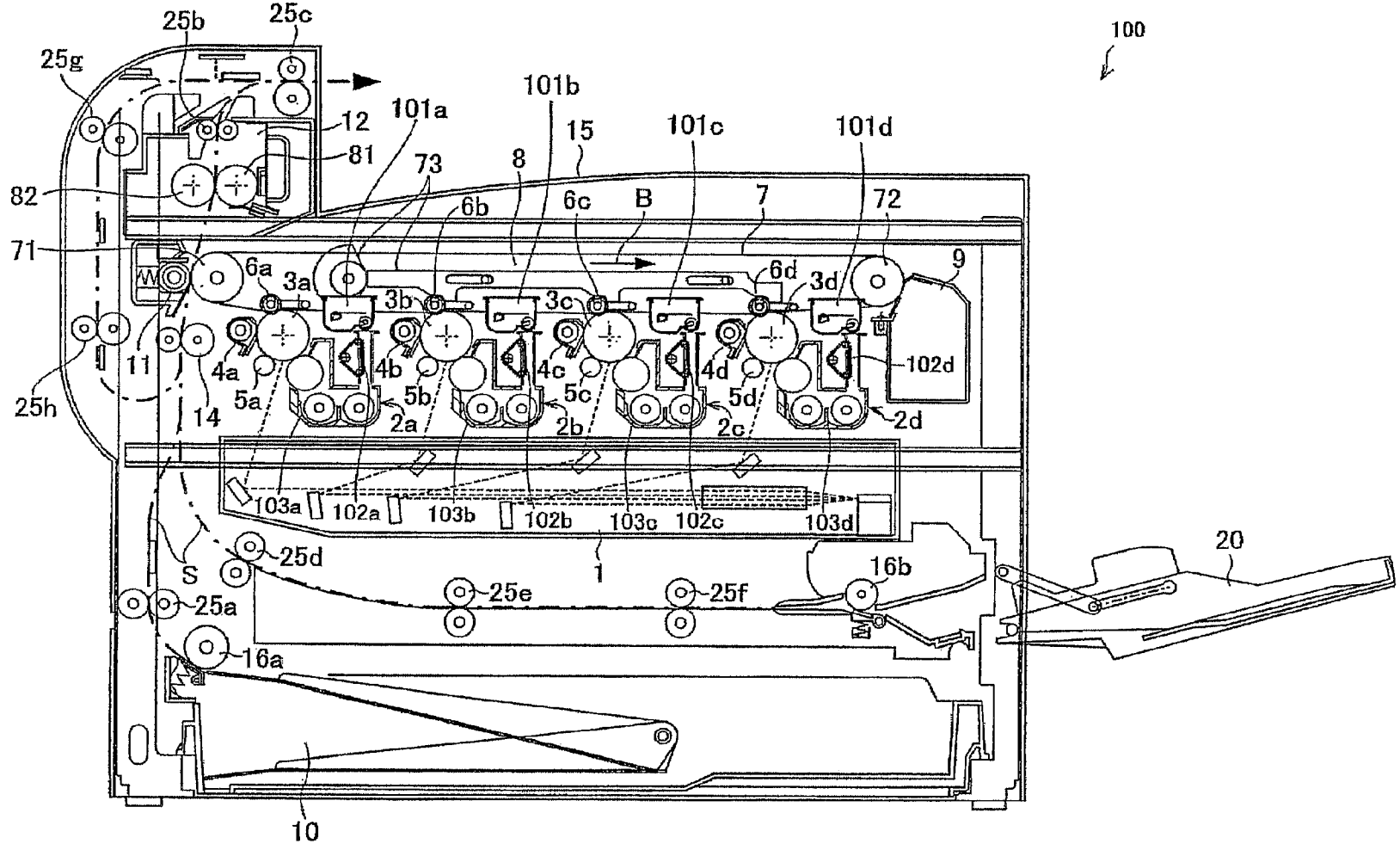
FIG. 1 is an illustrative view showing an overall configuration of an image forming apparatus including a developing device according to the first embodiment of the present invention.

FIG. 1 is an illustrative view of one exemplary embodiment of the invention, showing the overall configuration of an image forming apparatus including a developing device according to the first embodiment of the present invention.

An image forming apparatus 100 of the first embodiment forms an image with toners based on electrophotography, including: as shown in FIG. 1, photoreceptor drums 3 for forming electrostatic latent images on the surface thereof; chargers (charging devices) 5 for charging the surfaces of photoreceptor drums 3; an exposure unit (exposure device) 1 for forming electrostatic latent images on the photoreceptor drum 3 surfaces; developing devices 2 for supplying toners to the electrostatic latent images on the photoreceptor drum 3 surfaces to form toner images; toner hoppers (toner supplying devices) 101 for supplying toners to developing devices 2; an intermediate transfer belt unit (transfer device) 8 for transferring the toner images from the photoreceptor drum 3 surfaces to a recording medium; and a fusing unit (fusing device) 12 for fusing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To being with, the overall configuration of image forming apparatus 100 will be described.

Image forming apparatus 100 handles image data of separate color components, i.e., black (K), cyan (C), magenta (M) and yellow (Y), and forms black, cyan, magenta and yellow images to form a full-color image from the images of different color components, by superposing one over another.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four charging devices 5 (5*a*, 5*b*, 5*c* and 5*d*) and four cleaner units 4 (4*a*, 4*b*, 4*c* and 4*d*) to form images of four different colors. In other words, four image forming stations (image forming portions) each include one developing device 2, one photoreceptor drum 3, one charger 5 and cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fusing unit 12, a sheet conveyor system S and a paper feed tray 10 and a paper output tray 15.

Charger 5 uniformly electrifies the photoreceptor drum 3 surface at a predetermined potential.

As charger 5, other than the contact roller-type charger shown in FIG. 1, a contact brush-type charger, or an on-contact type discharging type charger may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 visualizes (develops) the electrostatic latent image formed on photoreceptor drum 3 with toner of K, C, M or Y. Developing device 2 (2*a*, 2*b*, 2*c* or 2*d*) includes a toner hopper 101 (101*a*, 101*b*, 101*c* or 101*d*), a toner transport mechanism 102 (102*a*, 102*b*, 102*c* or 102*d*), a developing vessel (developer receptacle) 111 shown in FIG. 2.

Toner hopper 101 is arranged on the upper side of developing vessel 111 and stores unused toner (power toner) The unused toner in toner hopper 101 is supplied to developing vessel 111 by means of toner transport mechanism 102.

Cleaner unit 4 removes and collects the toner remaining on the photoreceptor drum 3 surface after development and image transfer.

Arranged over photoreceptor drums 3 are an intermediate transfer belt unit 8. Intermediate transfer belt unit 8 includes intermediate transfer rollers 6 (6*a*, 6*b*, 6*c* and 6*d*), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at respective intermediate transfer roller fitting portions in intermediate transfer belt tensioning mechanism 73 of intermediate transfer belt unit 8. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multi-color toner image). This intermediate transfer belt 7 is formed of an endless film of about 100 to 150 μm thick, for instance.

Transfer of the toner image from photoreceptor drum 3 to intermediate transfer belt 7 is effected by intermediate transfer roller 6 which is in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.,) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image thus formed on each of photoreceptor drums 3 is developed with the toner associated with its color component into a visual toner image. These toner images are laminated on intermediate transfer belt 7, laying one image over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Since the toner adhering to intermediate transfer belt 7 as the belt comes in contact with photoreceptor drums 3, or the toner which has not been transferred from intermediate transfer belt 7 to the paper during transfer of the toner image and remains on intermediate transfer belt 7, would cause contamination of color toners at the next operation, it is removed and collected by an intermediate transfer belt cleaning unit 9.

Intermediate transfer belt cleaning unit 9 includes a cleaning blade (cleaning member) that comes into contact with intermediate transfer belt 7. Intermediate transfer belt 7 is supported from its interior side by intermediate transfer belt driven roller 72, at the portion where this cleaning blade comes into contact with intermediate transfer belt 7.

Paper feed tray 10 is to stack sheets (e.g., recording paper) to be used for image forming and is disposed under image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fusing unit 12. Here, the transfer portion is located between intermediate transfer belt drive roller 71 and transfer roller 11.

Arranged along sheet conveyor system S are pickup rollers 16*a*, 16*b*, a registration roller 14, the transfer portion, fusing unit 12 and feed rollers 25*a* to 25*h* and the like.

Feed rollers 25*a* to 25*h* are a plurality of small-diametric rollers arranged along sheet conveyor system S to promote and assist sheet conveyance. Pickup roller 16*a* is a roller disposed at the side of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 is a roller that temporarily suspends the sheet being conveyed on sheet conveyor system S and delivers it to the transfer portion at such timing that the front end of the sheet meets the front end of the image information area on intermediate transfer belt 7.

Fusing unit 12 includes a heat roller 81, a pressing roller 82 and the like. These heat roller 81 and pressing roller 82 rotate while nipping the sheet. Heat roller 81 is controlled by a controller (not shown) so as to keep a predetermined fusing temperature. This controller controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. Then, the sheet with a multi-color toner image (a single color toner image) fused thereon is conveyed by plural feed rollers 25 to the inversion paper discharge path of sheet conveyor system S and discharged onto paper output tray 15 in an inverted position (with the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out, as described above. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image information area including a lamination of toner images on intermediate transfer belt 7. At the transfer portion, the toner image is transferred onto the sheet. Then, this toner image is fused onto the sheet by fusing unit 12. Thereafter, the sheet passes through feed roller 25*b* to be discharged by paper output roller 25*c* to paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet which has been printed on the first side and passed through fusing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, developing device 2 of the first embodiment will be described with reference to the drawings.

Figure 2:
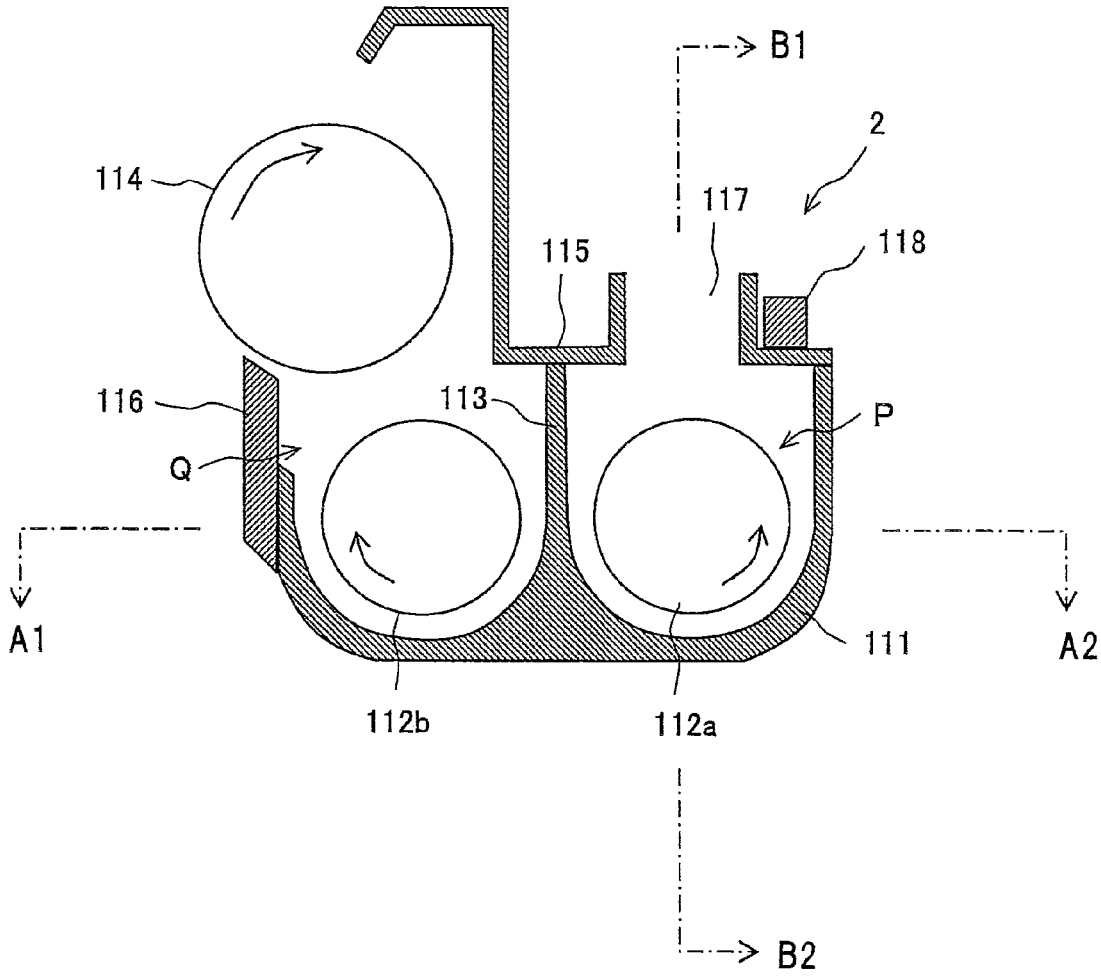
FIG. 2 is a sectional view showing the configuration of the developing device constituting the image forming apparatus.
Figure 3:
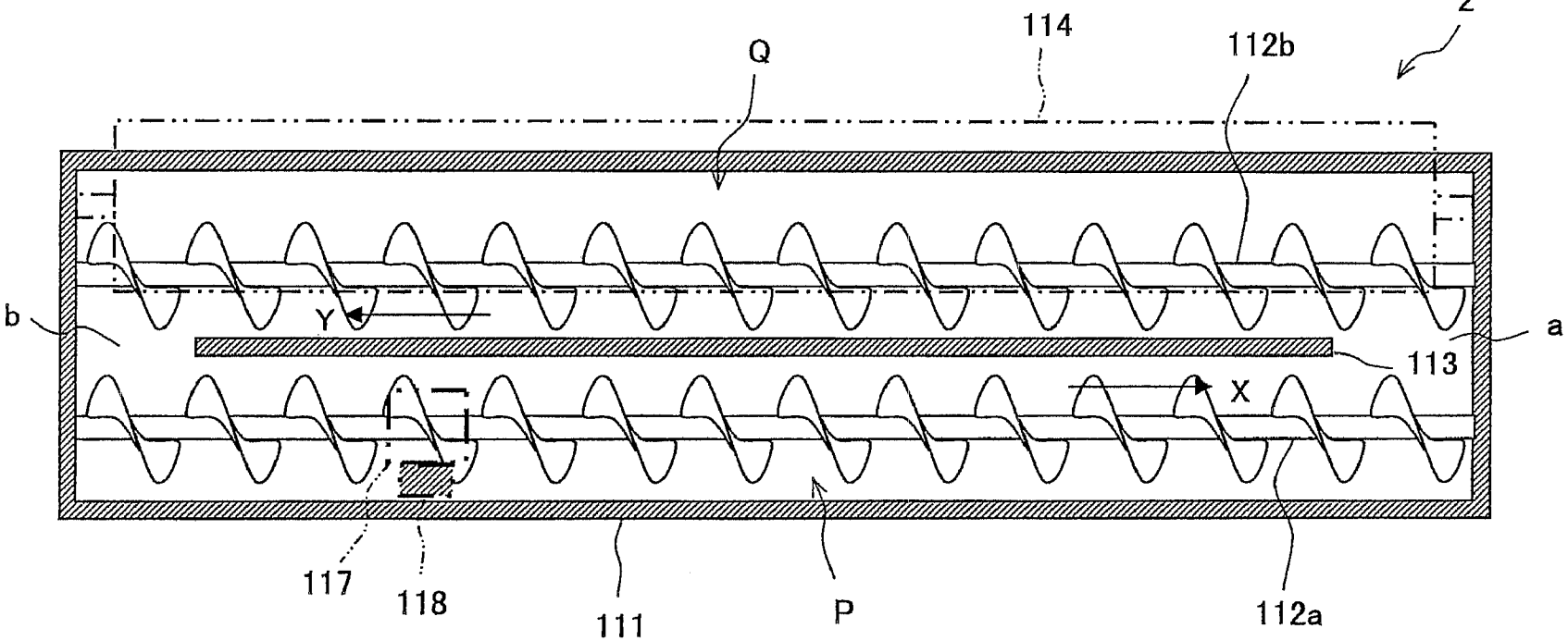
FIG. 3 is a sectional view cut along a plane A1-A2 in FIG. 2.
Figure 4:
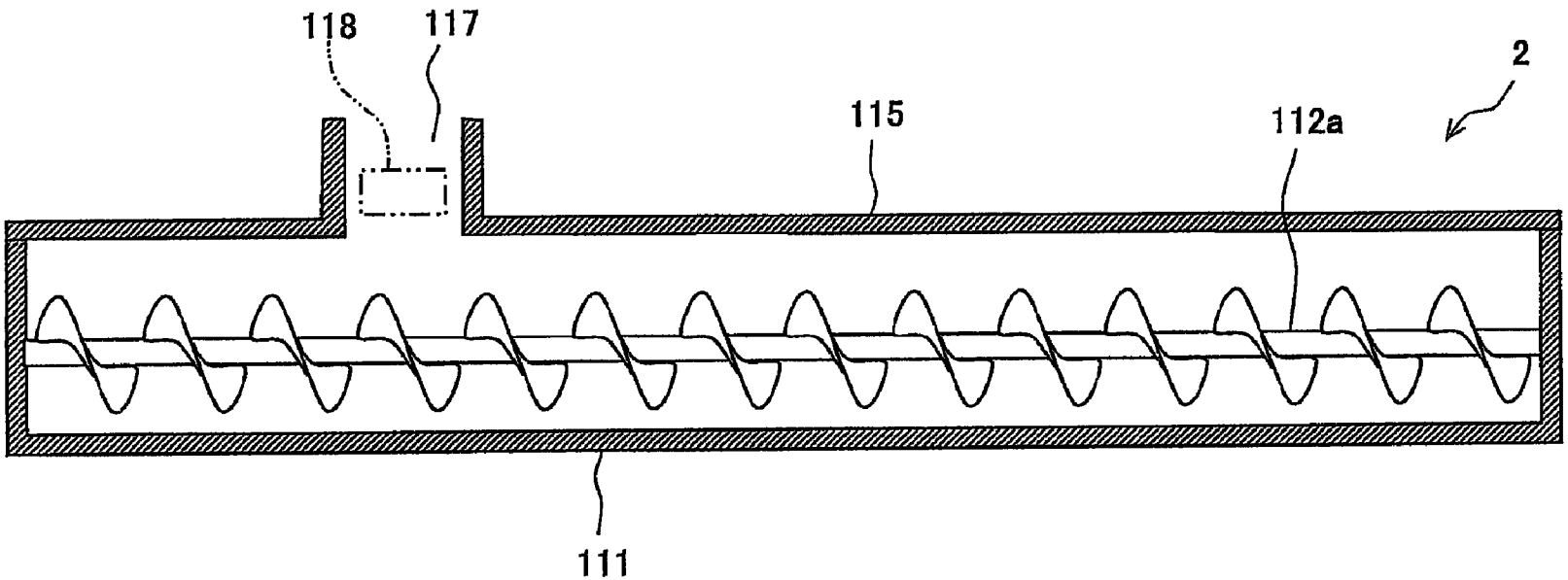
FIG. 4 is a sectional view cut along a plane B1-B2 in FIG. 2.

FIG. 2 is a sectional view showing the configuration of the developing device constituting the image forming apparatus of the first embodiment; FIG. 3 is a sectional view cut along a plane A1-A2 in FIG. 2; and FIG. 4 is a sectional view cut along a plane B1-B2 in FIG. 2.

Developing device 2 has a developing roller (developer supporting member) 114 arranged in developing vessel 111 so as to oppose photoreceptor drum 3 (FIG. 1), and supplies toner from developing roller 114 to the photoreceptor drum 3 surface to visualize (develop) the electrostatic latent image formed on the surface of photoreceptor drum 3.

Developing device 2 includes, other than developing roller 114, developing vessel 111, a developing vessel cover (developer receptacle cover) 115, a toner supply port 117, a doctor blade 116, a first conveying member 112*a*, a second conveying member 112*b*, a partitioning plate (partitioning wall) 113 and an electromagnet 118.

Developing vessel 111 is a receptacle for holding a developer including a toner and a carrier. Developing vessel 111 includes developing roller 114, first conveying member 112*a*, second conveying member 112*b* and the like. Here, the carrier of the present embodiment is a magnetic carrier made of a magnetic substance.

Developing roller 114 is a rotating magnet roller which draws up the developer in developing vessel 111 and supports the developer on the surface thereof and supplies toner from the developer supported on the surface thereof to photoreceptor drum 3 (FIG. 1). Doctor blade (layer thickness regulating blade) 116 is disposed at a position close to the developing roller 114 surface.

Developing vessel cover 115 is removably arranged on the top of developing vessel 111 as shown in FIGS. 2 and 4.

Further, developing vessel cover 115 is formed with toner supply port 117 for supplying unused toner to developing vessel 111 as shown in FIG. 4 and provided with electromagnet 118 in the vicinity of toner supply port 117 as shown in FIG. 2. More specifically, electromagnet 118 is arranged adjacent to the outer periphery of toner supply port 117.

Electromagnet 118 is arranged on top of developing vessel cover 115. Electromagnet 118 is disposed, at the same position with toner supply port 117 with respect to the developer's direction of conveyance X (FIG. 3) of first conveying member 112*a*, and on the upstream side of toner supply port 117 with respect to the rotational direction of first conveying member 112*a* (FIGS. 2 to 4).

In this arrangement, the toner stored in toner hopper 101 is transported to developing vessel 111 (FIG. 2) through toner transport mechanism 102 and toner supply port 117 as shown in FIG. 1, and thereby supplied to developing vessel 111.

Further, as shown in FIGS. 2, 3 and 4, first conveying member 112*a* and second conveying member 112*b* are formed of screw augers of a helical conveyor blade for agitating and conveying the developer inside developing vessel 111 so as to agitate and convey the developer as their shafts are rotationally driven by a drive means (not shown) such as a motor etc.

First conveying member 112*a* and second conveying member 112*b* are arranged so that their peripheral sides oppose each other with a partitioning plate 113 put therebetween and their shafts are positioned parallel to each other. These conveying members are set so as to rotate in opposite directions. As shown in FIG. 3, first conveying member 112*a* conveys the developer in the direction of arrow X while second conveying member 112*b* conveys the developer in the direction of an arrow Y that is the opposite direction of arrow X.

Developing vessel 111 includes partitioning plate 113 between first conveying member 112*a* and second conveying member 112*b*. This partitioning plate 113 is arranged extending parallel to the direction of the shafts (the direction of rotational axes) of first conveying member 112*a* and second conveying member 112*b*. The interior of developing vessel 111 is divided by partitioning plate 113 into two sections, namely, a first conveying passage P with first conveying member 112*a* and a second conveying passage Q with second conveying member 112*b*.

Partitioning plate 113 is arranged so that its ends, with respect to the axial direction of first and second conveying members 112*a* and 112*b*, are spaced from respective interior wall surfaces of developing vessel 111. Hereby, developing vessel 111 has communicating paths that communicate between first conveying passage P and second conveying passage Q at around both axial ends of first and second conveying members 112*a* and 112*b*. In the following description, the communicating path formed on the downstream side with respect to the direction of arrow X is named first communicating path a and the communicating path formed on the downstream side with respect to the direction of arrow Y is named second communicating path b.

In the first embodiment, toner supply port 117 is formed in the region inside first conveying passage P and on the downstream side of second communicating path b with respect to the direction of arrow X. In one word, toner is supplied into first conveying passage P at a position on the downstream side of second communicating path b.

In developing vessel 111, first conveying member 112*a* and second conveying member 112*b* are rotationally driven by a drive means (not shown) such as a motor etc., to convey the developer.

More specifically, in first conveying passage P, the developer is agitated and conveyed in the direction of arrow X by first conveying member 112*a* to reach first communicating path a. The developer reaching first communicating path a is conveyed therethrough to second conveying passage Q.

On the other hand, in second conveying passage Q, the developer is agitated and conveyed in the direction of arrow Y by second conveying member 112*b* to reach second communicating path b. Then, the developer reaching second communicating path b is conveyed therethrough to first conveying passage P.

That is, first conveying member 112*a* and second conveying member 112*b* agitate the developer while conveying it in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the drawn up developer is continuously consumed as moving toward photoreceptor drum 3.

In order to compensate for this consumption of toner, unused toner is supplied from toner supply port 117 into first conveying passage P. The supplied toner is agitated and mixed with the previously existing developer in the first conveying passage P.

Figure 5:
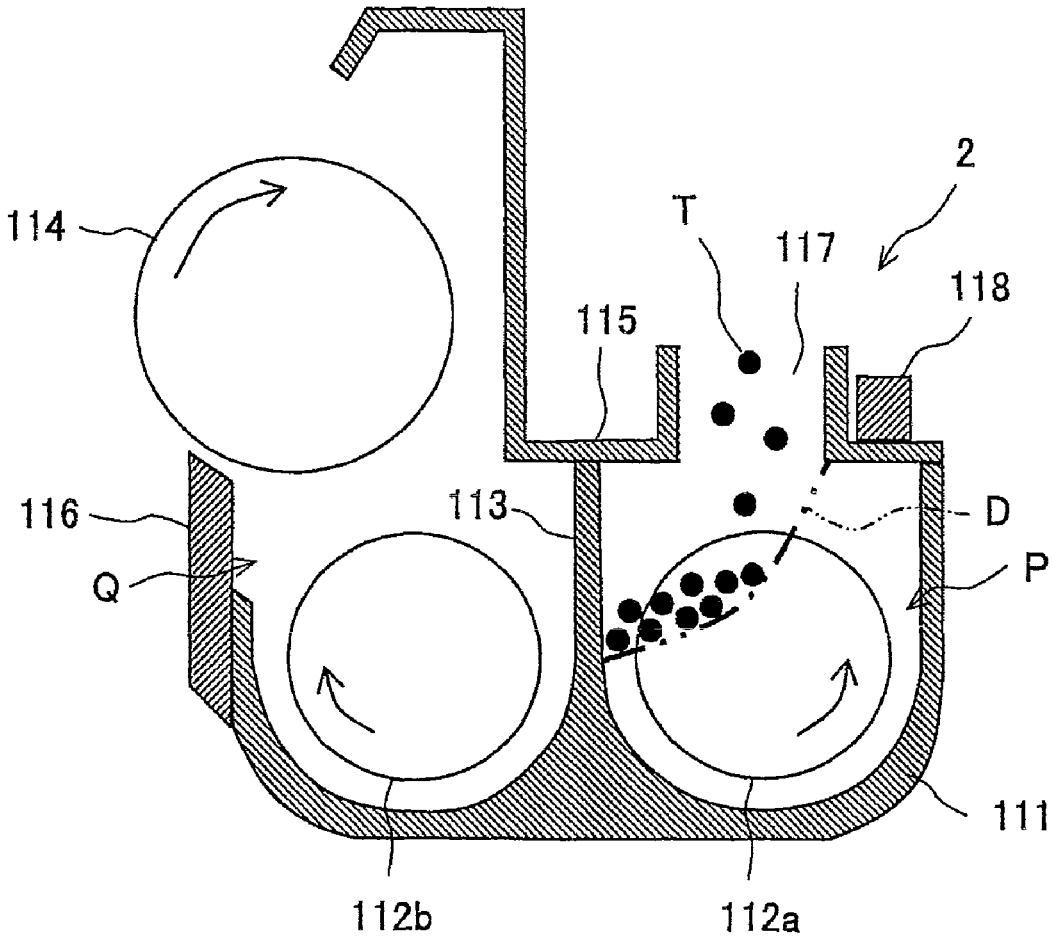
FIG. 5 is an illustrative view showing a state of the developing device in which supplied toner is mixed with the developer which has been attracted to the electromagnet being energized by flowing current.
Figure 6:
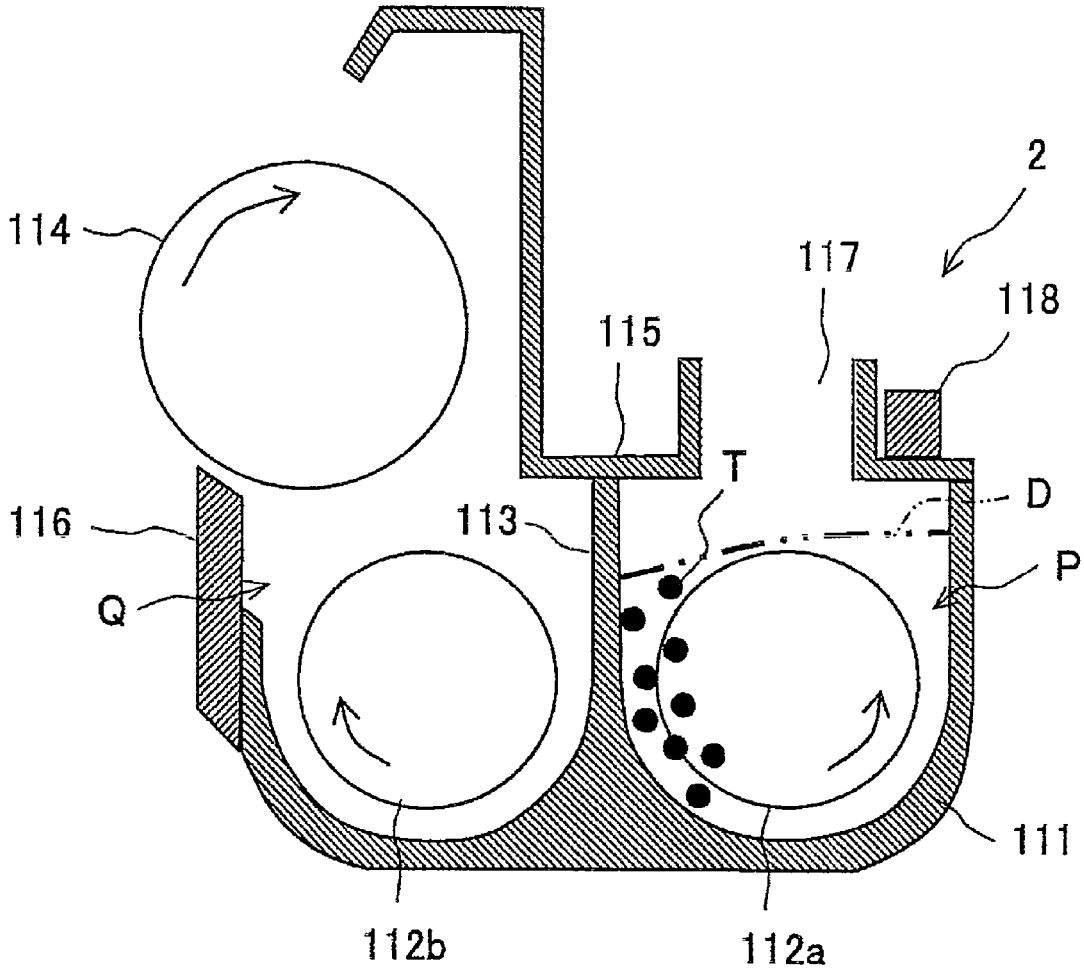
FIG. 6 is an illustrative view showing a state of the developing device in which supplied toner is mixed with the developer which was attracted to the electromagnet and has moved away from the electromagnet after the current through the electromagnet was turned off.

Referring now to FIGS. 5 and 6, the mixing and agitating action of supplied toner T and developer D in developing vessel 111 of developing device 2 according to the first embodiment will be described.

FIG. 5 is an illustrative view showing a state of the developing device of the image forming apparatus of the first embodiment, in which supplied toner T is mixed with the developer D that has been attracted to electromagnet 118 being energized by flowing current. FIG. 6 is an illustrative view showing a state of the same developing device in which supplied toner T is mixed with the developer D that was attracted to electromagnet 118 and has moved away from electromagnet 118 after the current through electromagnet 118 was turned off.

In developing device 2, when electromagnet 118 disposed close to the periphery of toner supply port 117 of developing vessel 111 is energized by flowing current, developer D is attracted to the magnetic field generated by electromagnet 118 as shown in FIG. 5, so that the toner (supplied toner) T fed from toner supply port 117 of developing vessel 111 falls to the region where developer D is low in height. Thereafter, when the current through electromagnet 118 is stopped, the developer D that has been attracted to electromagnet 118 is released from electromagnet 118 and flows over the supplied toner T, as shown in FIG. 6.

In the first embodiment, when supplying toner, the operation control is performed such that a magnetic field is generated intermittently around toner supply port 117 by periodically turning on and off the current through electromagnet 118 on a cycle ranging from 0.5 sec. to 2 sec., so as to repeat attraction (raising) of developer D located under toner supply port 117 and releasing (dropping) of it. As a result, it is possible to promote developer D to move up and down.

If the cycle is less than 0.5 sec., the necessary developer's follow ability cannot be secured so that it is difficult to achieve the expected promoting effect of the vertical movement of the developer. On the other hand, if the cycle exceeds 2 sec., it is impossible to obtain effective vertical movement of the developer.

Therefore, according to the first embodiment, it is possible to improve the mixture performance of developer D with supplied toner T fed from toner supply port 117 in first conveying passage P. Then, the supplied toner T is fully agitated with developer D by means of first conveying member 112*a* in first conveying passage P to obtain the necessary amount of static charge. As a result, it is possible to reduce toner scattering and image fogging due to an insufficiency of static charge on the toner, and hence provide fine images.

Further, since use of a helical screw auger as first conveying member 112*a* makes developer D easily move in the rotational direction of first conveying member 112*a*, the developer D located under toner supply port 117 can be promptly attracted toward electromagnet 118 when the magnetic field is created by the electromagnet 118, securing improved response of developer D to electromagnet 118.

Further, since electromagnet 118 is disposed on the upstream side of toner supply port 117 with respect to the rotational direction of first conveying member 112*a*, developer D is collected on the upstream side with respect to the rotational direction of first conveying member 112*a* when the developer D located under toner supply port 117 is attracted to electromagnet 118 by the influence of its magnetic field. Accordingly, an empty space is formed on the downstream side with respect to the rotational direction of first conveying member 112*a*, so that supplied toner T can be made to fall into this space. Then, the developer that has been attracted flows over the supplied toner T after cancellation of the magnetic field of electromagnet 118, hence it is possible to easily mix the toner into the developer even if the toner has a low specific weight.

The Second Embodiment

Next, the developing device according to the second embodiment of the present invention will be described with reference to the drawings.

Figure 7:
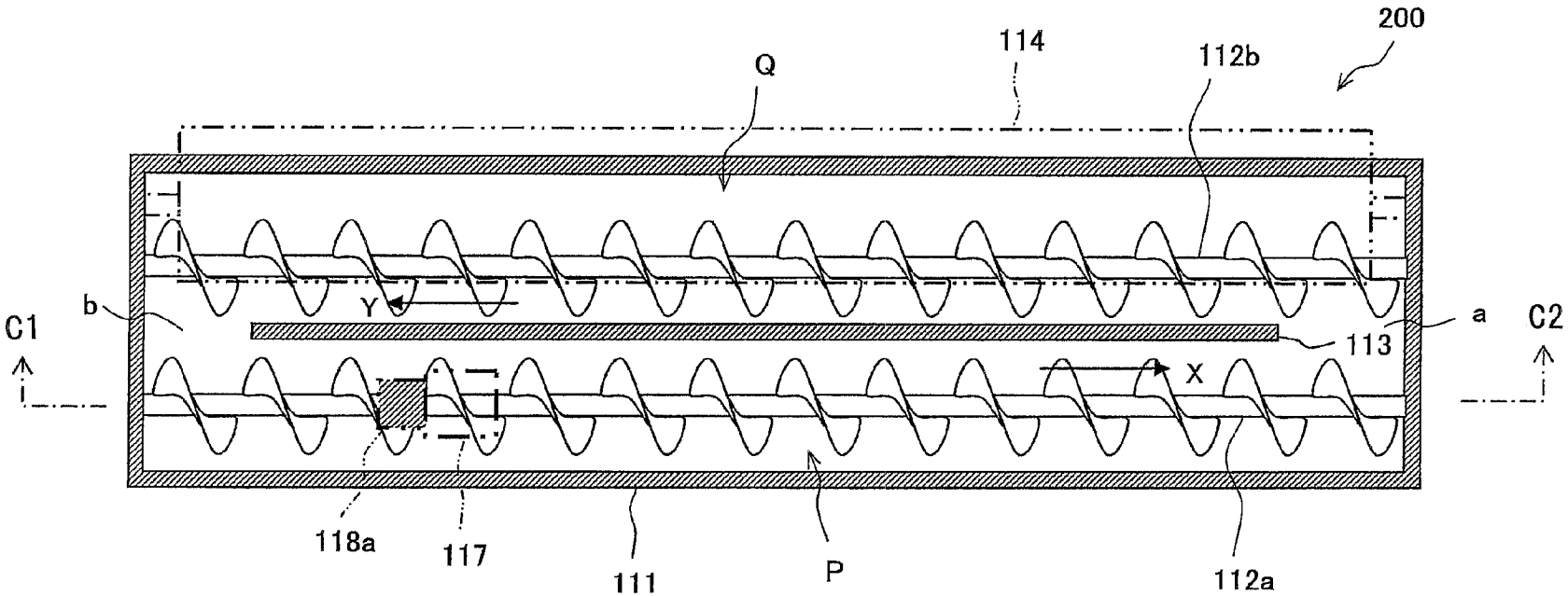
FIG. 7 is a sectional view showing the configuration of a developing device according to the second embodiment of the present invention.
Figure 8:
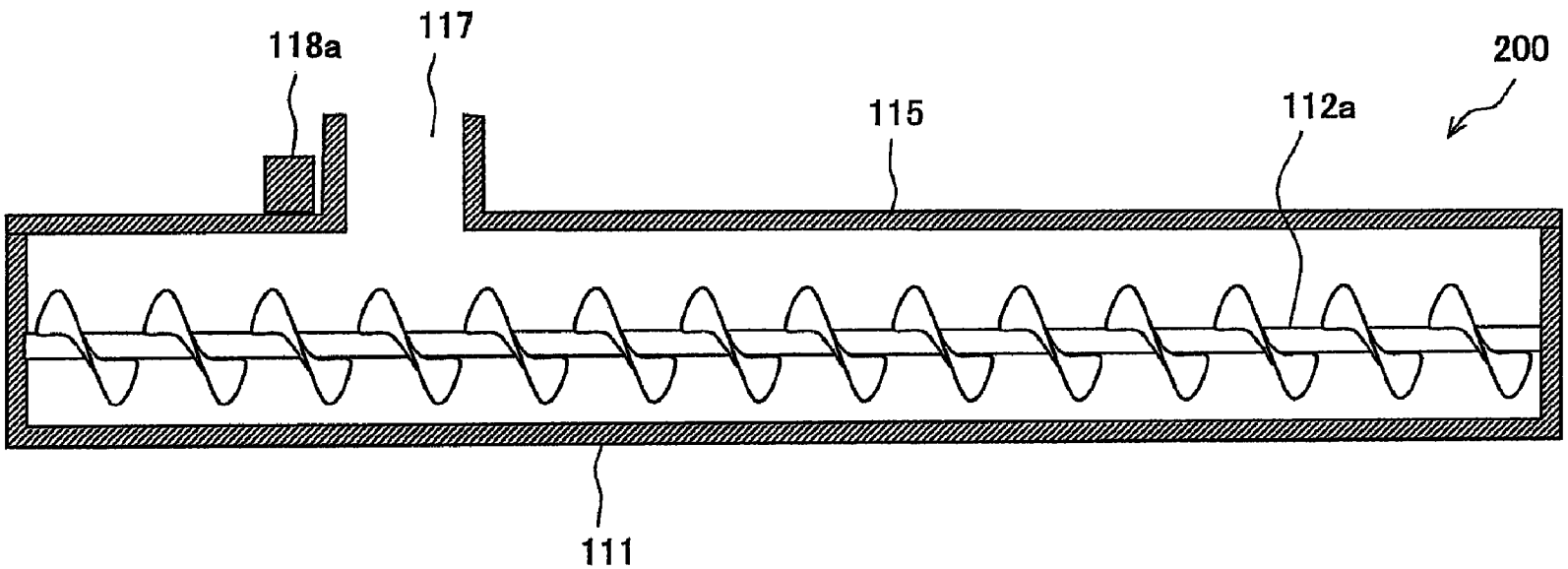
FIG. 8 is a sectional view cut along a plane C1-C2 in FIG. 7.

FIG. 7 is a sectional view showing the configuration of the developing device according to the second embodiment of the present invention. FIG. 8 is a sectional view cut along a plane C1-C2 in FIG. 7.

Here, FIG. 7 is the sectional view corresponding to FIG. 3 in developing device 2 in the first embodiment described above, and FIG. 8 is the sectional view corresponding to the same developing device 2 in FIG. 4.

As shown in FIGS. 7 and 8, a developing device 200 of the second embodiment includes, other than developing roller 114, a developing vessel 111, a developing vessel cover 115, a toner supply port 117, a first conveying member 112*a*, a second conveying member 112*b*, a partitioning plate (partitioning wall) 113 and an electromagnet 118*a*.

Electromagnet 118*a* is arranged near toner supply port 117 on top of developing vessel cover 115 (FIGS. 7 and 8). More specifically, electromagnet 118*a* is disposed adjacent to the outer periphery of toner supply port 117. Electromagnet 118*a* is disposed on the upstream side of toner supply port 117 with respect to the developer's direction of conveyance X (FIG. 7) of first conveying member 112*a*, and at the same position with toner supply port 117 with respect to the rotational direction of first conveying member 112*a*.

Here, since developing device 200 has the same Configuration as the above-described developing device 2 of the first embodiment except in that the position of electromagnet 118*a* is different from that in developing device 2, the components, other than electromagnet 118*a*, having the same configurations are allotted with the same reference numerals so that their description is omitted.

Figure 9:
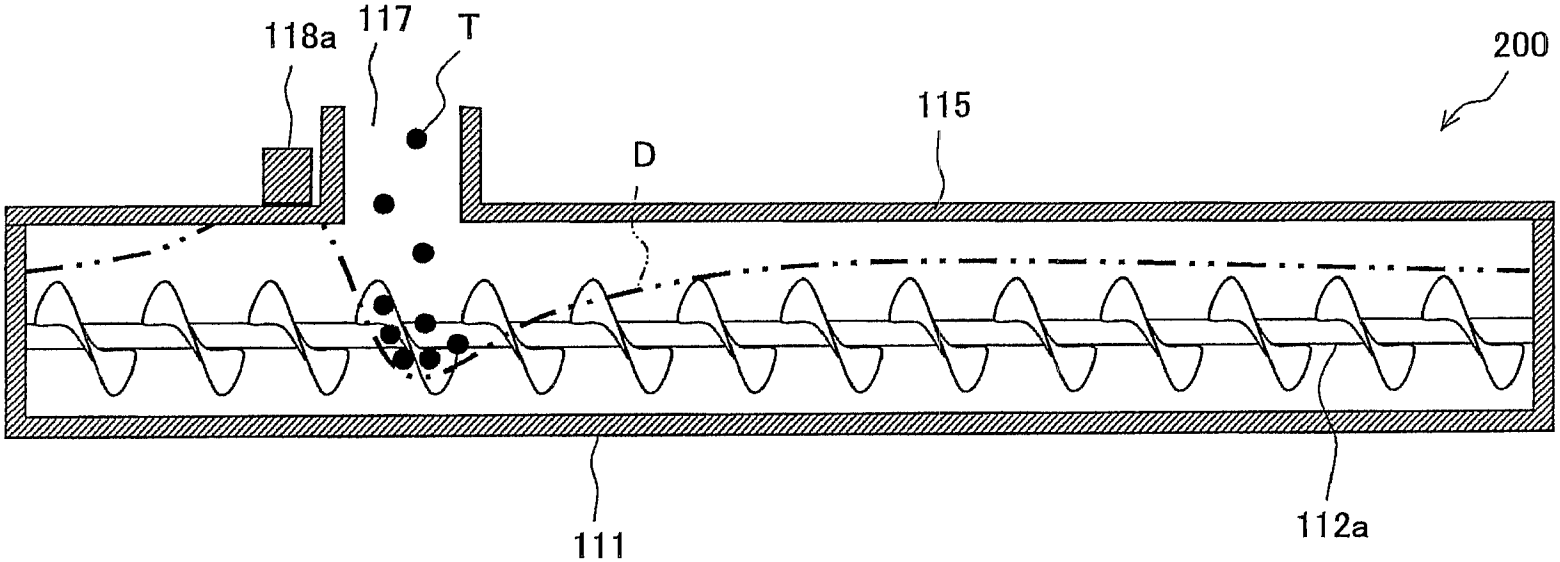
FIG. 9 is an illustrative view showing a state of the developing device in which the electromagnet that is being energized by flowing current has attracted the developer to obstruct the flow of the developer.
Figure 10:
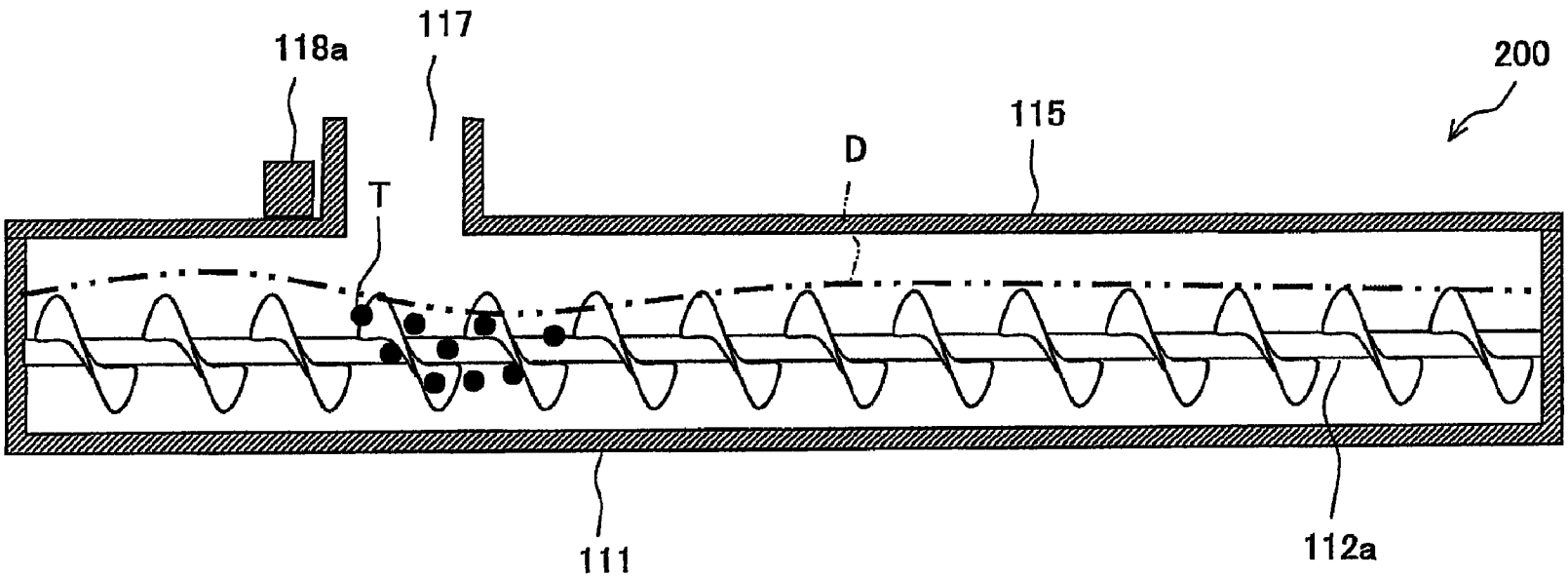
FIG. 10 is an illustrative view showing a state of the developing device in which supplied toner is mixed with the developer which was attracted to the electromagnet and obstructed to flow, and has moved away from the electromagnet after the current through the electromagnet was turned off.

Referring to FIGS. 9 and 10, the mixing and agitating action of supplied toner T and developer D in developing vessel 111 of developing device 200 according to the second embodiment will be described.

FIG. 9 is an illustrative view showing a state of the developing device of the second embodiment, in which electromagnet 118*a* that is being energized by flowing current has attracted developer D to interrupt the flow of the developer. FIG. 10 is an illustrative view showing a state of the same developing device in which supplied toner T is mixed with developer D which was attracted to electromagnet 118*a* and obstructed to flow, and has moved away from electromagnet 118*a* after the current through electromagnet 118*a* was turned off.

In developing device 200, when electromagnet 118*a* disposed at the periphery of toner supply port 117 of developing vessel 111 is energized by flowing current, developer D is attracted to, and obstructed to flow in first conveying passage P by, the magnetic field generated by electromagnet 118*a* as shown in FIG. 9, so that the supplied toner T fed from toner supply port 117 of developing vessel 111 falls to the region where developer D is low in height. Thereafter, when the current through electromagnet 118*a* is stopped, the developer D that has been attracted to, and obstructed to flow in first conveying passage P, by electromagnet 118*a*, flows over the supplied toner T, as shown in FIG. 10.

In the second embodiment, when supplying toner, the operation control is performed such that a magnetic field is generated intermittently around toner supply port 117 by periodically turning on and off the current through electromagnet 118*a* on a cycle ranging from 0.5 sec. to 2 sec., so as to repeat attraction (raising) of developer D located under toner supply port 117 and releasing (dropping) of it. As a result, it is possible to promote developer D to move up and down.

Therefore, according to the second embodiment, similarly to the first embodiment, it is possible to improve the mixture performance of developer D with supplied toner T fed from toner supply port 117 in first conveying passage P. Then, the supplied toner T is fully agitated with developer D by means of first conveying member 112*a* in first conveying passage P to obtain the necessary amount of static charge.

The Third Embodiment

Next, the developing device according to the third embodiment of the present invention will be described with reference to the drawings.

Figure 11:
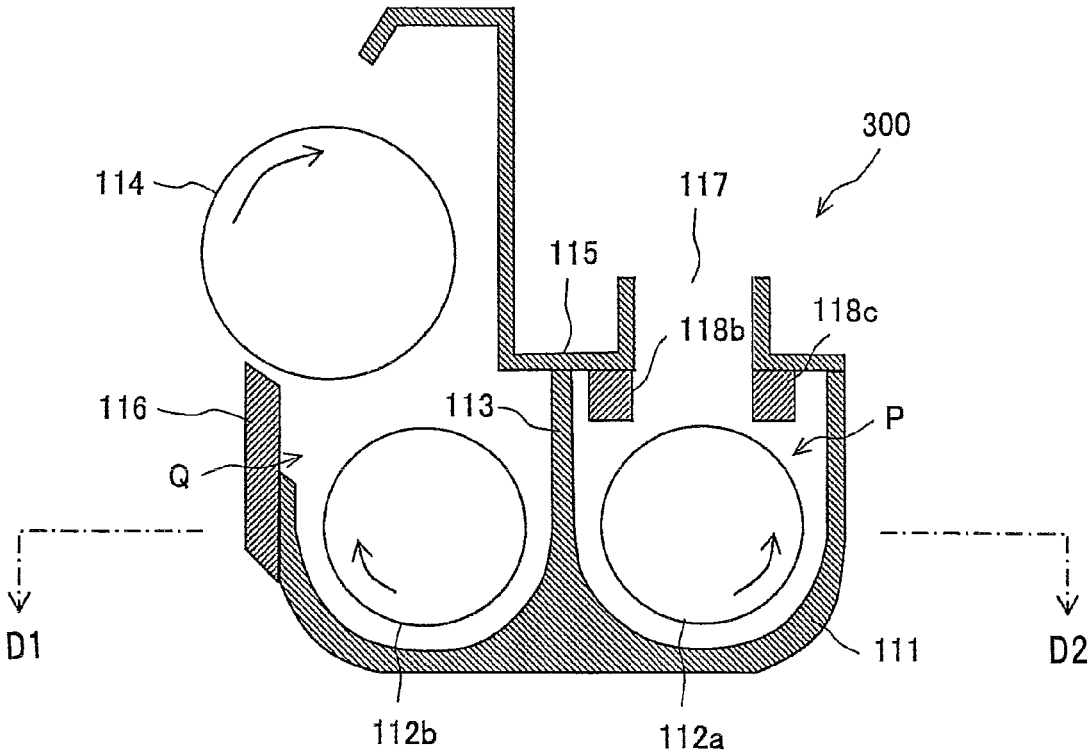
FIG. 11 is a sectional view showing the configuration of a developing device according to the third embodiment of the present invention.
Figure 12:
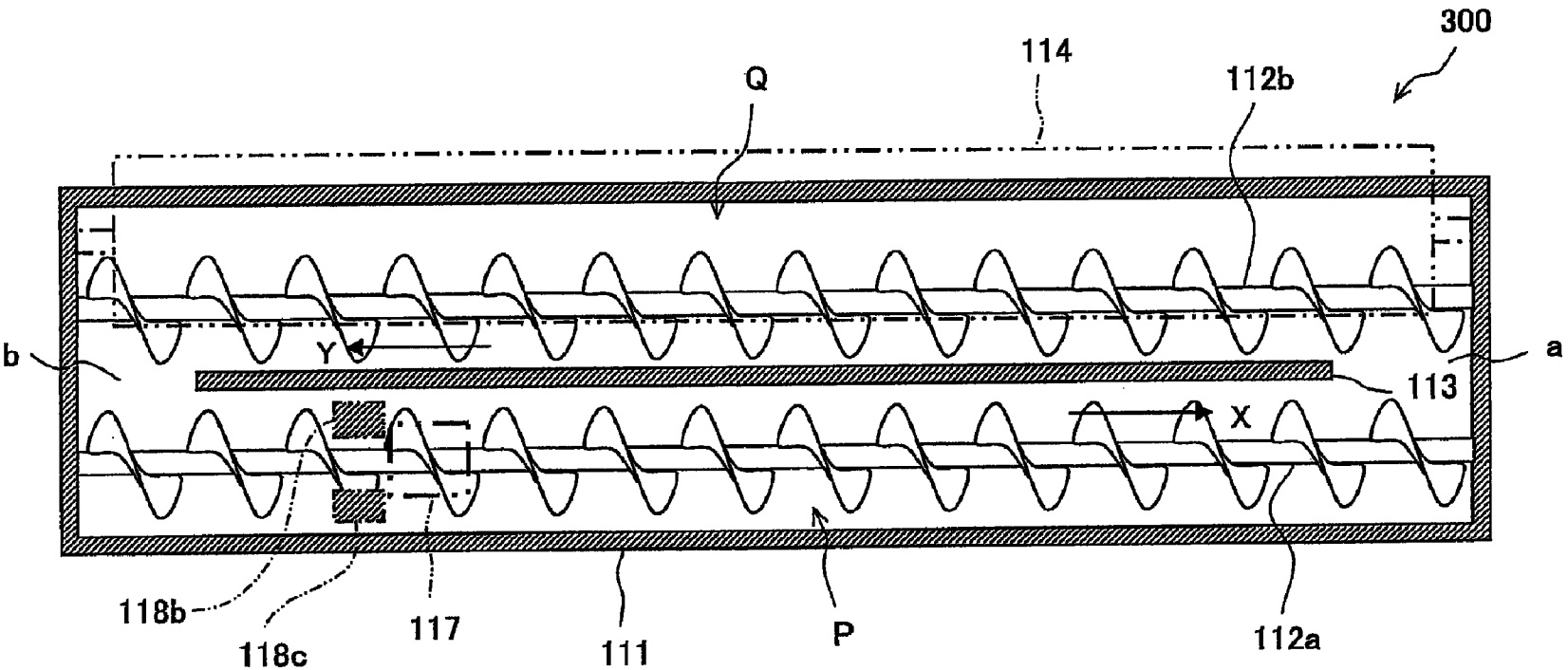
FIG. 12 is a sectional view cut along a plane D1-D2 in FIG. 11.

FIG. 11 is a sectional view showing the configuration of the developing device according to the third embodiment of the present invention. FIG. 12 is a sectional view cut along a plane D1-D2 in FIG. 11.

As shown in FIGS. 11 and 12, a developing device 300 of the third embodiment includes, other than developing roller 114, a developing vessel 111, a developing vessel cover 115, a toner supply port 117, a doctor blade 116, a first conveying member 112*a*, a second conveying member 112*b*, a partitioning plate (partitioning wall) 113 and electromagnets 118*b* and 118*c*.

Electromagnets 118*b* and 118*c* are arranged near toner supply port 117 on the ceiling of the first conveying passage P (the upper interior surface of developing vessel 111). More specifically, electromagnets 118*b* and 118*c* are disposed adjacent to the outer periphery of toner supply port 117 (FIGS. 11 and 12). Electromagnets 118*b* and 118*b* are disposed opposing each other and apart from each other by the width of the opening of toner supply port 117, at positions on the upstream side of toner supply port 117 with respect to the developer's direction of conveyance X (FIG. 12) of first conveying member 112*a* and on the upstream side and downstream side of toner supply port 117 with respect to the rotational direction of first conveying member 112*a*.

Here, since developing device 300 has the same configuration as the above-described developing device 2 of the first embodiment except in that the arrangement of electromagnets 118*b* and 118*c* is different from that in developing device 2, the components, other than electromagnets 118*b* and 118*c*, having the same configurations are allotted with the same reference numerals so that their description is omitted.

Next, the mixing and agitating action of supplied toner T and developer D in developing vessel 111 of developing device 300 according to the third embodiment will be described.

In developing device 300, when electromagnets 118*b* and 118*c* disposed at the periphery of toner supply port 117 of developing vessel 111 are energized by flowing current, developer D is attracted to, and obstructed to flow in first conveying passage P by, electromagnets 118*b* and 118*c* (see the state of developer D in FIG. 9), so that the supplied toner T fed from toner supply port 117 of developing vessel 111 falls to the region where developer D is low in height. Thereafter, when the current through electromagnets 118*b* and 118*c* is stopped, the developer D that has been attracted to, and obstructed to flow in first conveying passage P, by electromagnets 118*b* and 118*c*, flows over the supplied toner T (see the state of developer D in FIG. 10).

In the third embodiment, when supplying toner, the operation control is performed such that a magnetic field is generated intermittently around toner supply port 117 by periodically turning on and off the current through electromagnets 118*b* and 118*c* on a cycle ranging from 0.5 sec. to 2 sec., so as to repeat attraction (raising) of developer D located under toner supply port 117 and releasing (dropping) of it. As a result, it is possible to promote developer D to move up and down.

Therefore, according to the third embodiment, similarly to the first and second embodiments, it is possible to improve the mixture performance of developer D with supplied toner T fed from toner supply port 117 in first conveying passage P. Then, the supplied toner T is fully agitated with developer D by means of first conveying member 112*a* in first conveying passage P to obtain the necessary amount of static charge.

The Fourth Embodiment

Next, the developing device according to the fourth embodiment of the present invention will be described with reference to the drawings.

Figure 13:
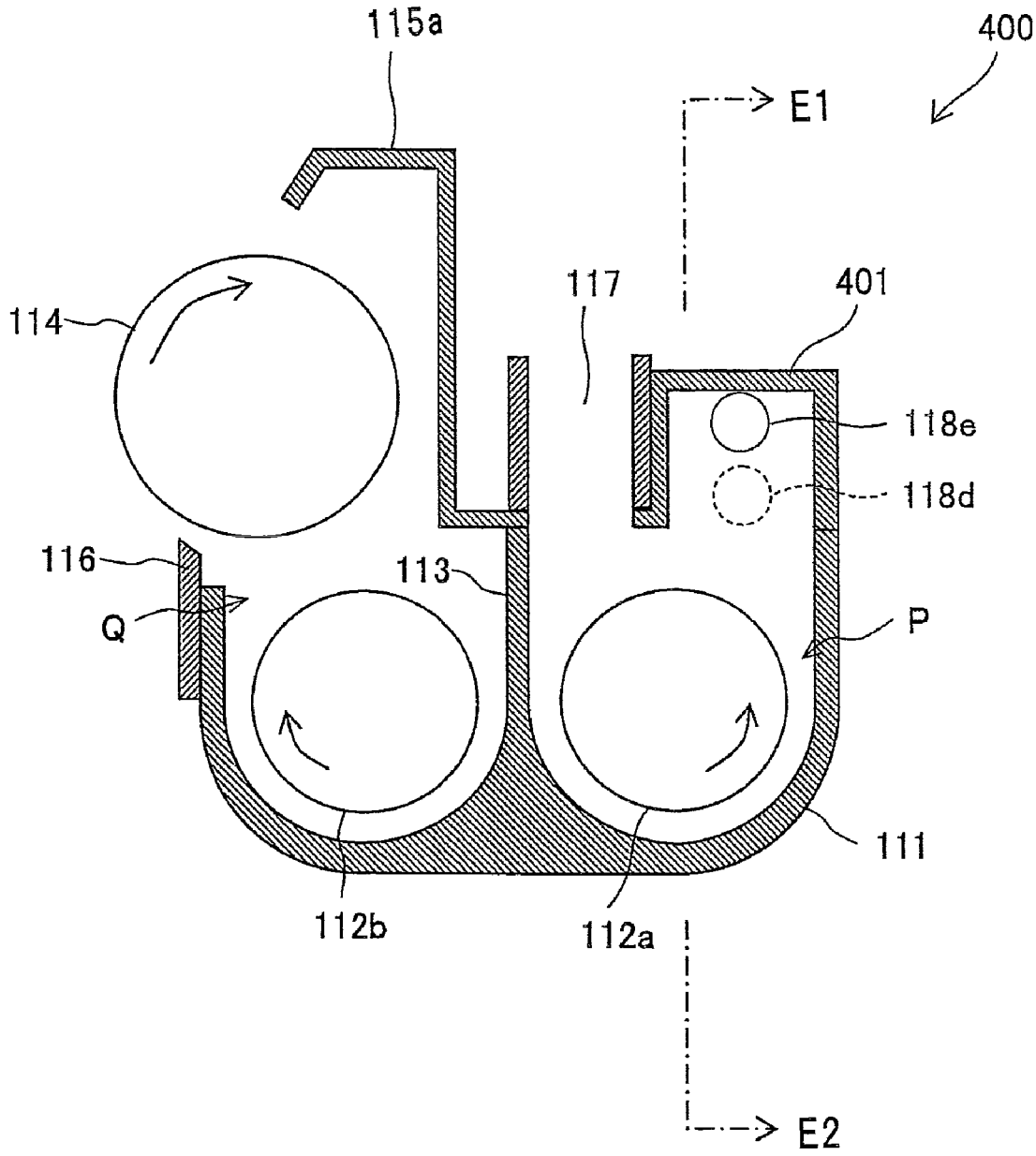
FIG. 13 is a sectional view showing the configuration of a developing device according to the fourth embodiment of the present invention.
Figure 14:
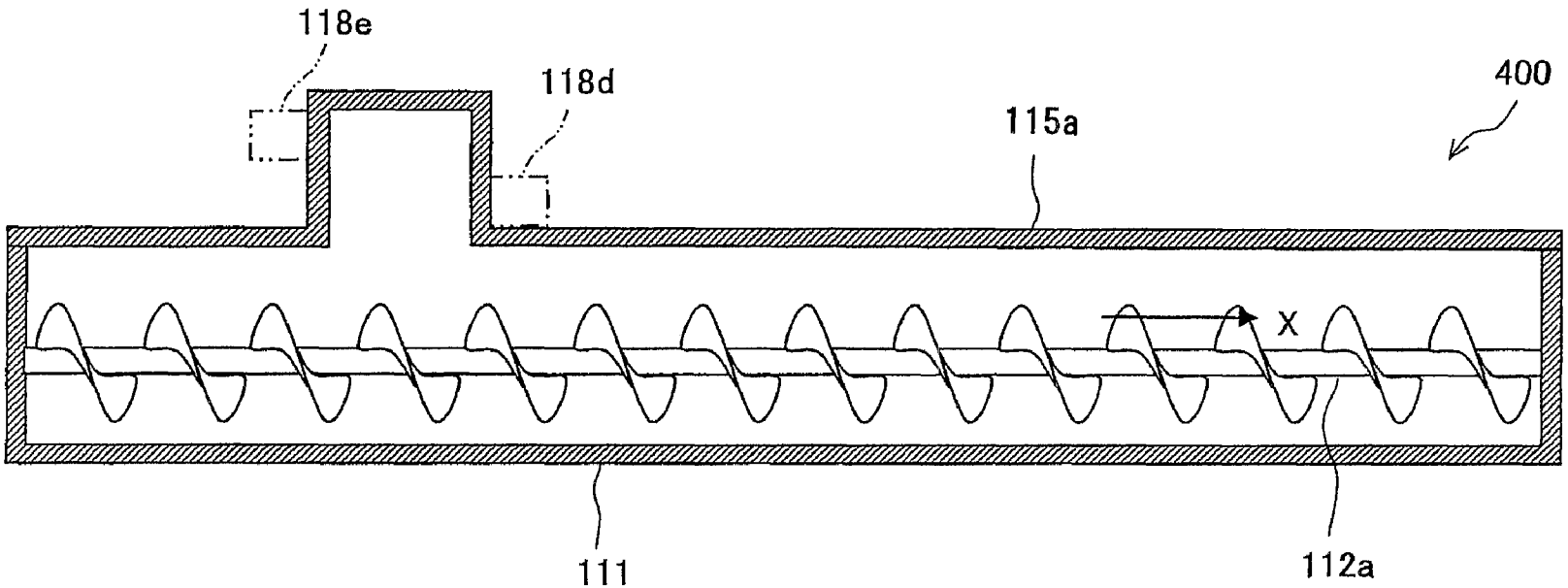
FIG. 14 is a sectional view cut along a plane E1-E2 in FIG. 13.
Figure 15:
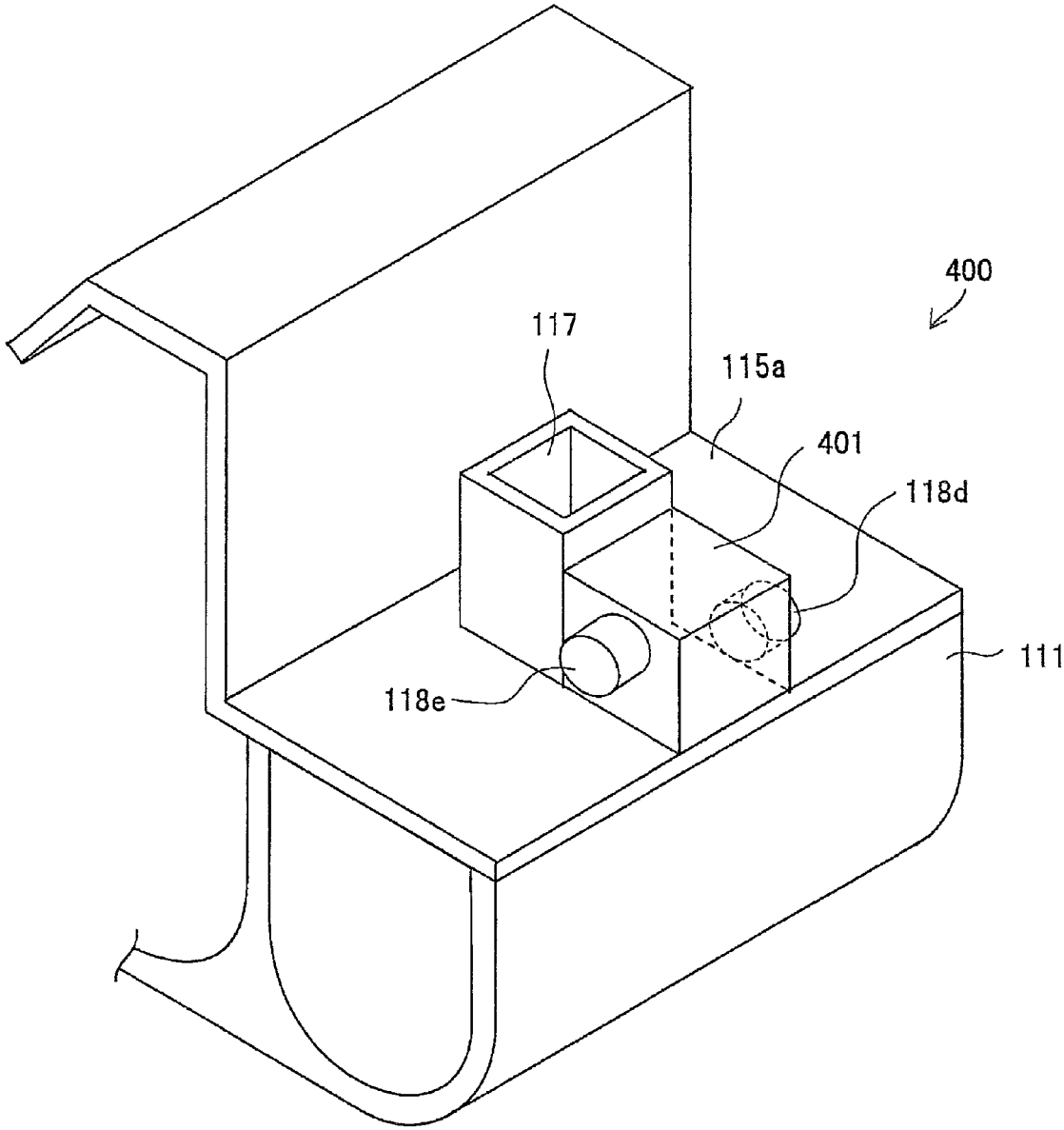
FIG. 15 is an enlarged perspective view showing the vicinity of the toner supply port in FIG. 13.

FIG. 13 is a sectional view showing the configuration of the developing device according to the fourth embodiment of the present invention. FIG. 14 is a sectional view cut along a plane E1-E2 in FIG. 13. FIG. 15 is an enlarged perspective view showing the vicinity of the toner supply port in FIG. 13.

Here, FIG. 13 is the sectional view corresponding to FIG. 3 in developing device 2 in the first embodiment described above, and FIG. 14 is the sectional view corresponding to the same developing device 2 in FIG. 4.

As shown in FIGS. 13, 14 and 15, a developing device 400 of the fourth embodiment includes a developing vessel 111, a developing roller 114, a doctor blade 116, a toner supply port 117, a first conveying member 112*a*, a second conveying member 112*b*, a partitioning plate (partitioning wall) 113, a developing vessel cover 115*a* including a developer retreat 401, and first and second electromagnets 118*d* and 118*e* disposed in the outer periphery (vicinity) of toner supply port 117.

Developer retreat 401 is formed adjacent to the outer periphery of toner supply port 117. More specifically, developer retreat 401 is disposed, at the same position with toner supply port 117 with respect to the developer's direction of conveyance X (FIG. 14) of first conveying member 112*a*, and on the upstream side of toner supply port 117 with respect to the rotational direction of first conveying member 112*a*. Developer retreat 401 has a parallel-piped configuration having a hollow therein.

First electromagnet 118*d* and second electromagnet 118*e* are arranged outside developer retreat 401 and on the opposing sides thereof and positioned so as to create a magnetic field in the hollow of developer retreat 401.

First electromagnet 118*d* and second electromagnet 118*e* are arranged apart from each other by the width of developer retreat 401 with respect to the developer's direction of conveyance X of first conveying member 112*a*, and positioned on the upstream side by the same distance from toner supply port 117 with respect to the rotational direction of first conveying member 112*a*.

First electromagnet 118*d* is located downstream of second electromagnet 118*e* with respect to the developer's direction of conveyance X.

As to the height (in the vertical direction) from the bottom of developing vessel 111, first electromagnet 118*d* is positioned closer to first conveying member 112*a* than second electromagnet 118*e*. In other words, first electromagnet 118*d* is arranged at a position closer to the surface of developer D stored inside developing vessel 111 than second electromagnet 118*e* is.

First electromagnet 118*d* and second electromagnet 118*e* form magnetic lines of force directed in the same directions toward developer retreat 401 so as to attract developer D into the interior space of developer retreat 401.

Here, since developing device 400 has the same configuration as the above-described developing device 2 of the first embodiment except in that the arrangement of electromagnets 118*d* and 118*e* and the configuration of developing vessel cover 115 are different from those of developing device 2, the components, other than electromagnets 118*d* and 118*e*, having the same configurations are allotted with the same reference numerals so that their description is omitted.

Referring to FIGS. 16 to 20, the mixing and agitating action of supplied toner T and developer D in developing vessel 111 of developing device 400 according to the fourth embodiment will be described.

Figure 16:
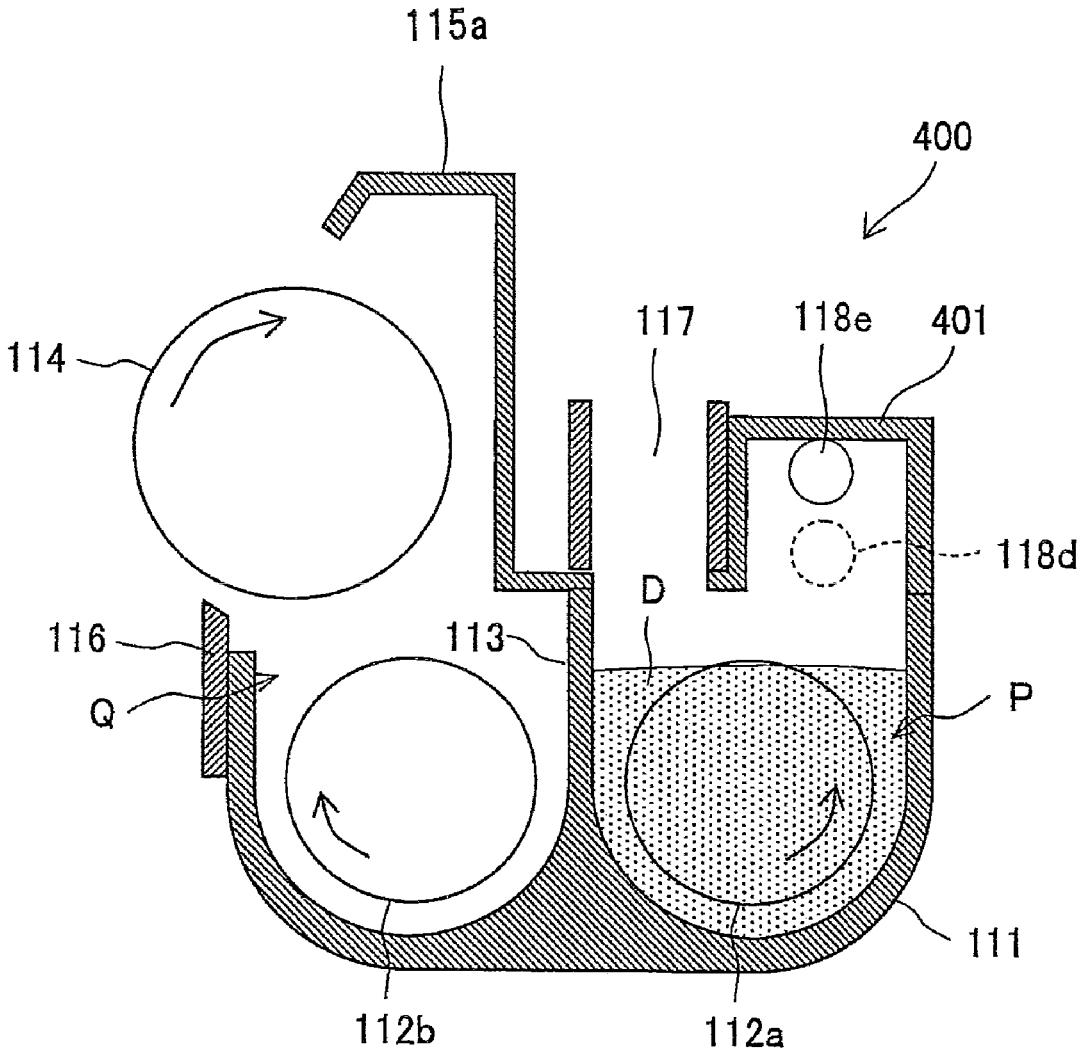
FIG. 16 is an illustrative view showing a state of the developing device (when toner is not supplied) in which no current flows through electromagnets.
Figure 17:
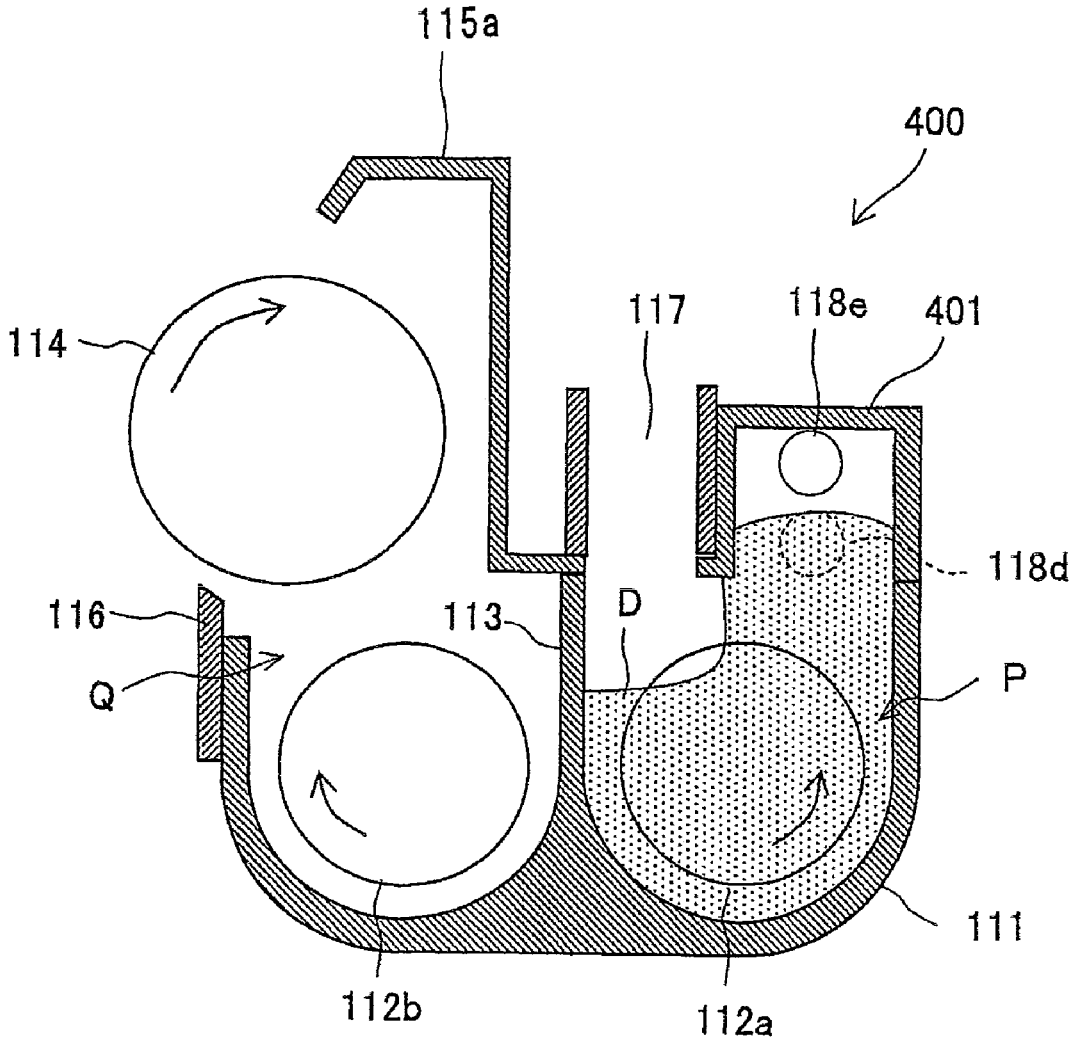
FIG. 17 is an illustrative view showing a state of the developing device in which the developer has been attracted to the first electromagnet when current is flowing through the first electromagnet.
Figure 18:
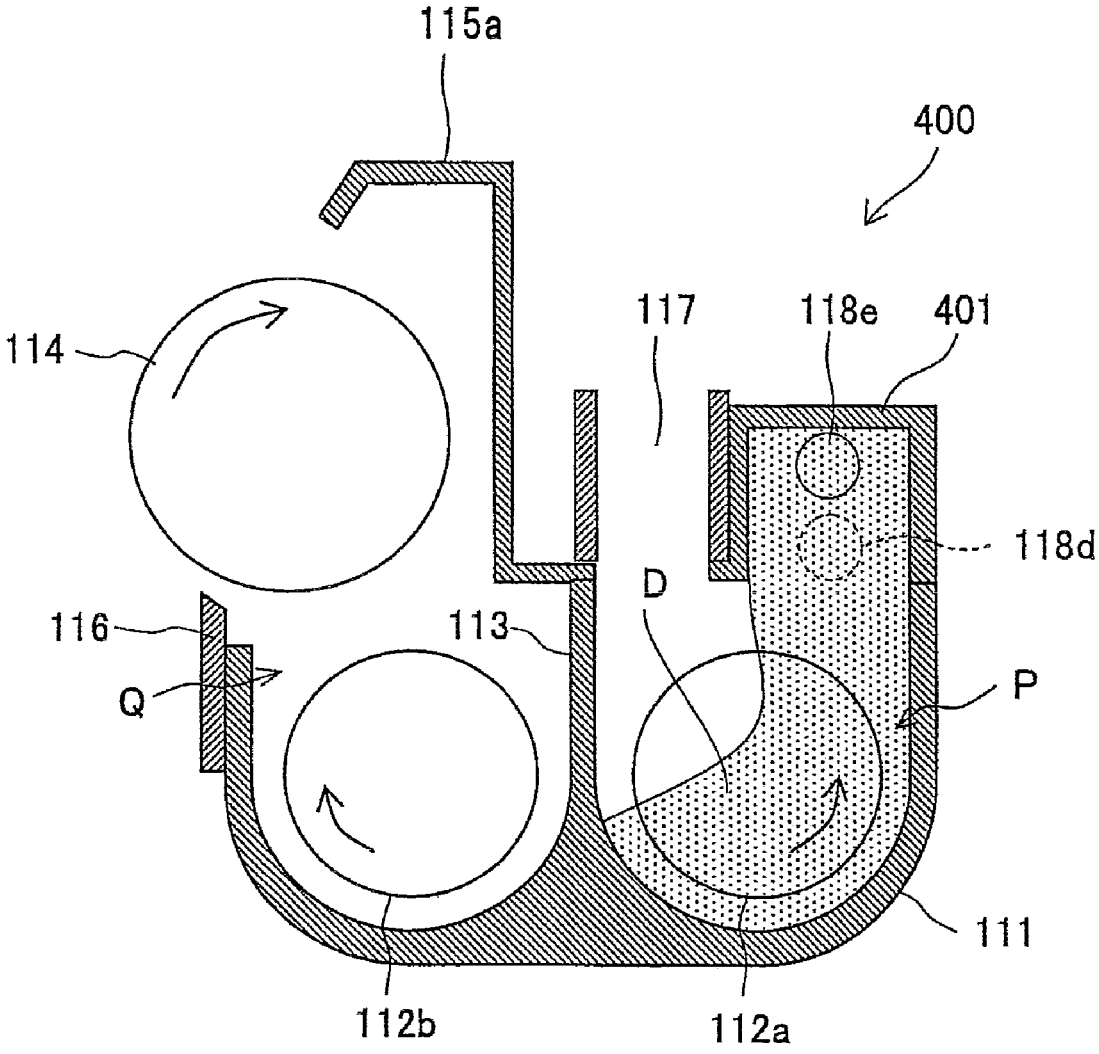
FIG. 18 is an illustrative view showing a state of the developing device in which the developer has been attracted to the electromagnets when current is flowing through the first and second electromagnets.

FIG. 16 is an illustrative view showing a state of the developing device (when toner is not supplied) in which no current flows through electromagnets 118*d* and 118*e*. FIG. 17 is an illustrative view showing a state of the developing device in which developer D has been attracted to first electromagnet 118*d* when current is flowing through first electromagnet 118*d*. FIG. 18 is an illustrative view showing a state of the developing device in which developer D has been attracted to electromagnets 118*d* and 118*e* when current is flowing through first and second electromagnets 118*d* and 118*e*. FIG.

Figure 20:
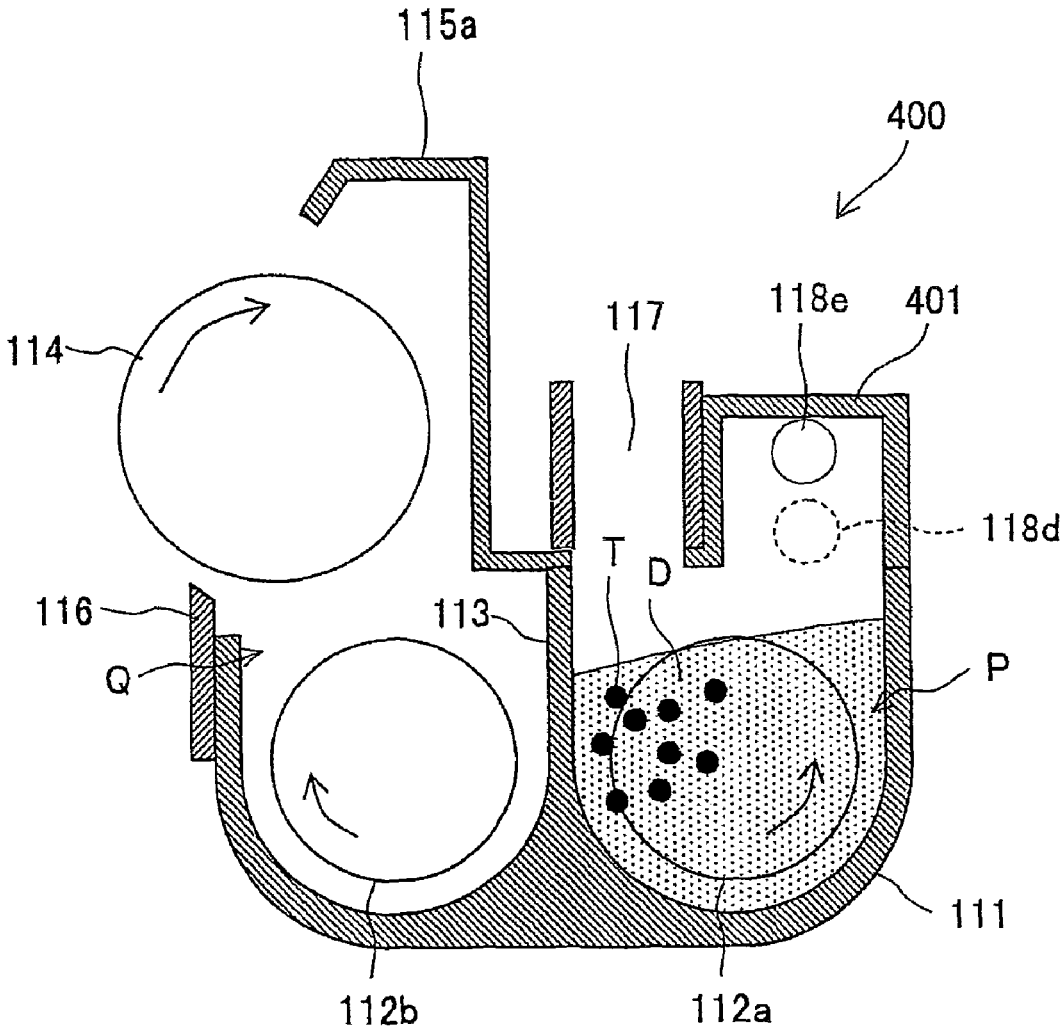

19 is an illustrative view showing a state of the developing device in which supplied toner T falls over the developer D that has been put aside in the developer conveying passage. FIG. 20 is an illustrative view showing a state of the developing device in which developer D has fallen to the developer conveying passage after current through electromagnets 118*d* and 118*e* was cut off.

In developing device 400, developer D resides below first and second electromagnets 118*d* and 118*e* as shown in FIG. 16 under the condition in which no current is flowing through first and second electromagnets 118*d* and 118*e* when toner is not supplied.

In supplying toner, when first electromagnet 118*d* (which is arranged at a position closer to the surface of developer D than second electromagnet 118*e* is) is energized, developer D is attracted to first electromagnet 118*d* and drawn into the space of developer retreat 401, as shown in FIG. 17. At this time, the level of the developer surface under toner supply port 117 falls or becomes low.

Figure 19:
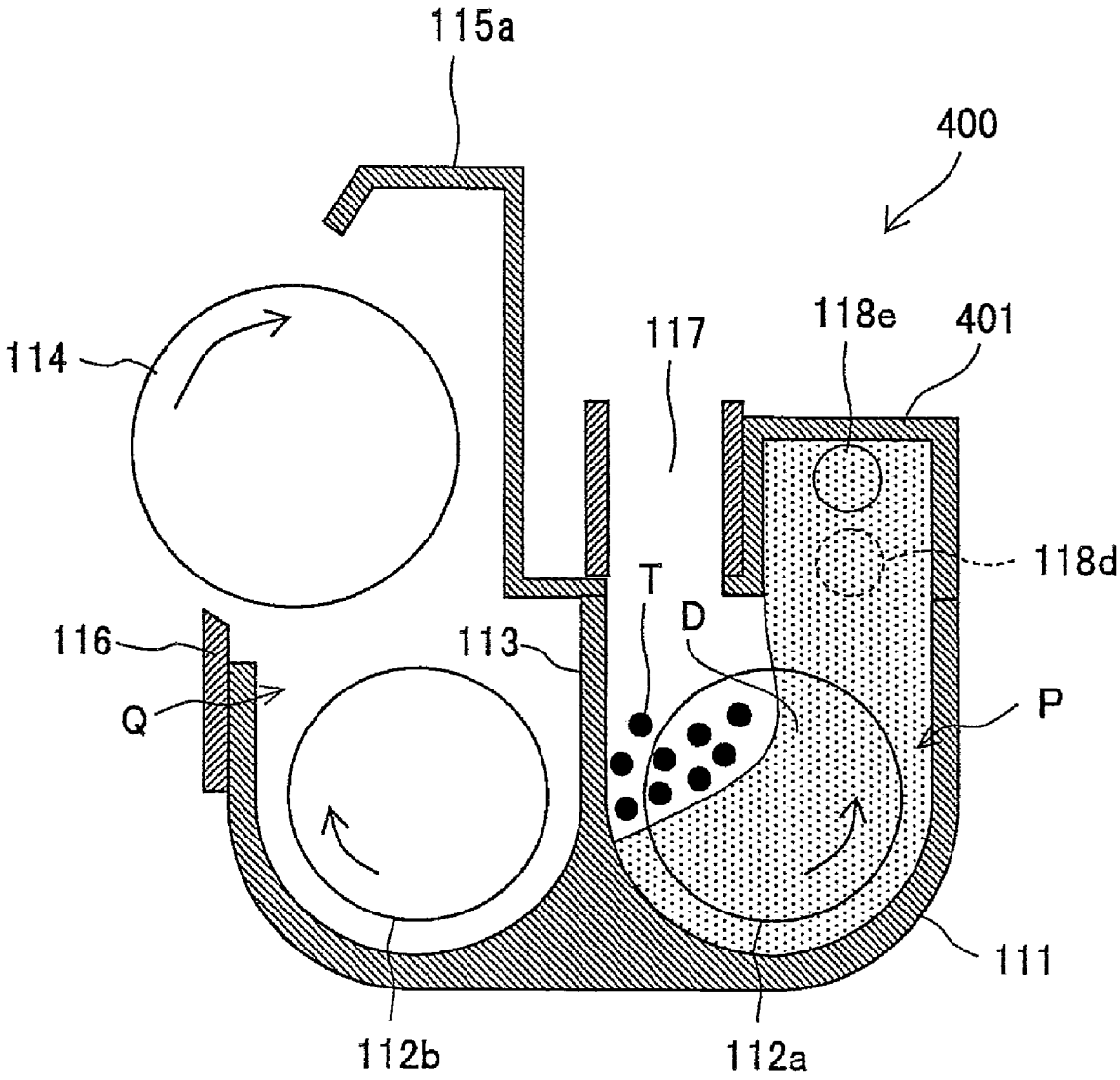
FIG. 19 is an illustrative view showing a state of the developing device in which supplied toner falls over the developer that has been put aside in the developer conveying passage; and, FIG. 20 is an illustrative view showing a state of the developing device in which the developer has fallen to the developer conveying passage after current through the electromagnets was cut off.

Then, when second electromagnet 118*e* is also energized, developer D is attracted to first and second electromagnets 118*d* and 118*e* and drawn further into the space of developer retreat 401, as shown in FIG. 18. At this time, the level of the developer surface under toner supply port 117 becomes further low. In this condition where the level of the developer has lowered, supplied toner T is fed from toner supply port 117 as shown in FIG. 19.

Thereafter, when the current through first and second electromagnets 118*d* and 118*e* is stopped, the developer D that has been held inside developer retreat 401 by first and second electromagnets 118*d* and 118*e* flows over the supplied toner T so as to mix the supplied toner T within developer D as shown in FIG. 20.

In the fourth embodiment, when supplying toner the operation control is performed such that a magnetic field is generated intermittently around toner supply port 117 by periodically turning on and off the current through first and second electromagnets 118*d* and 118*e* on a cycle ranging from 0.5 sec. to 2 sec., so as to repeat attraction (raising) of developer D located under toner supply port 117 and releasing (dropping) of it. As a result, it is possible to promote developer D to move up and down.

Therefore, according to the fourth embodiment, similarly to the first embodiment, it is possible to improve the mixture performance of developer D with supplied toner T fed from toner supply port 117 in first conveying passage P. Then, the supplied toner T is fully agitated with developer D by means of first conveying member 112*a* in first conveying passage P to obtain the necessary amount of static charge.

Since the developer which has been drawn up by first and second electromagnets 118*d* and 118*e* can be held inside the space of developer retreat 401, it is possible to draw up a large amount of developer D from first conveying passage P. It is hence possible to lower the surface level of developer D in first conveying passage P, so that the supplied toner falls into the lower part of the first conveying passage P. As a result, the rotational frictional force of first conveying member 112*a* becomes more influential so as to be able to improve the mixture performance of supplied toner T and developer D.

Further, provision of the developer retreat 401 also contributes to prevention against heat generation of the developer inside the developing vessel.

Though the above embodiments were described taking examples in which the developing device 2 of the present invention is applied to image forming apparatus 100 shown in FIG. 1, as long as it is an image forming apparatus in which toner is supplied to developing device 2 using toner hopper 101, the invention can be developed to any other image forming apparatus and the like, not limited to the image forming apparatus and copier described above.

Having described heretofore, the present invention is not limited to the above embodiments, various changes can be made within the scope of the appended claims. That is, any embodied mode obtained by combination of technical means modified as appropriate without departing from the spirit and scope of the present invention should be included in the technical art of the present invention.

What is claimed is:

1. A developing device comprising:

a developer receptacle for storing a developer containing a toner and a magnetic carrier;

a developer conveying passage through which the developer is conveyed;

a developer conveying member disposed inside the developer conveying passage to agitate and convey the developer in a predetermined direction;

a developer supporting member which supports the developer in the developer conveying passage to supply the toner contained in the developer to a photoreceptor drum;

a toner supply port for taking a supply of the toner into the developer conveying passage; and, an electromagnet provided at the outer periphery of the toner supply port, and wherein the toner supply port is formed over the developer conveying member, and the electromagnet intermittently attracts the developer residing under the toner supply port; and further including a developer receptacle cover provided on the top of the developer receptacle, wherein the toner supply port is formed in the developer receptacle cover, the developer receptacle cover includes a developer retreat that is projected upward to form a space capable of holding the developer inside the developer receptacle, the developer retreat is formed at the outer periphery of the toner supply port, and the electromagnet is arranged at such a position as to form a magnetic field in the space of the developer retreat.

2. The developing device according to claim 1, wherein the developer conveying member is comprised of a helical screw auger.

3. The developing device according to claim 1, wherein the electromagnet is disposed on the upstream side of the toner supply port with respect to the rotational direction of the developer conveying member.

4. The developing device according to claim 1, wherein the electromagnet is disposed on the upstream side of the toner supply port with respect to the developer's direction of conveyance by the developer conveying member.

5. The developing device according to claim 1, the electromagnet is constituted of a plurality of electromagnets each of which creates a magnetic field oriented in the same direction with that of others.

6. The developing device according to claim 5, wherein the plural electromagnets are energized successively from the one located closer to the developer.

7. The developing device according to claim 1, wherein the electromagnet is energized so as to form a magnetic field intermittently on a cycle ranging from 0.5 second to 2 seconds.

8. An image forming apparatus for forming images with toner based on electrophotography, comprising:

a photoreceptor drum that an electrostatic latent image is formed on the surface of;

a charging device for electrifying the surface of the photoreceptor drum;

an exposure device for forming the electrostatic latent image on the photoreceptor drum surface;

a developing device for forming a toner image by supplying toner to the electrostatic latent image on the photoreceptor drum surface;

a toner supply device for supplying the toner to the developing device;

a transfer device for transferring the toner image on the photoreceptor drum surface to a recording medium; and, a fusing device for fusing the toner image on the recording medium, and wherein the developing device employs the developing device defined in claim 1.

9. A toner supplying method for supplying toner to a developing device, the developing device comprising:

a developer receptacle for storing a developer containing a toner and a magnetic carrier;

a developer conveying passage through which the developer is conveyed;

a developer conveying member disposed inside the developer conveying passage to agitate and convey the developer in a predetermined direction; and, a toner supply port for taking a supply of the toner into the developer conveying passage, the method comprising the step of supplying the toner from the toner supply port into the developer receptacle while generating a magnetic field intermittently in the space under the toner supply port, and further comprising the steps of:

supplying toner when a magnetic field is generated under the toner supply port; and suspending toner supply when no magnetic field is generated under the toner supply port.

* * * * *